US011551496B1

(12) United States Patent
Maiga et al.

(10) Patent No.: US 11,551,496 B1
(45) Date of Patent: Jan. 10, 2023

(54) ACCESS CONTROL SYSTEMS, DEVICES, AND METHODS THEREFOR

(71) Applicant: PassiveBolt, Inc., Ann Arbor, MI (US)

(72) Inventors: Kabir Maiga, Superior Township, MI (US); Phillip Michael Johnson, Plymouth, MI (US); Simon Forster, Cologne (DE)

(73) Assignee: PassiveBolt, Inc., Ann Arbor, MI (US)

( * ) Notice: Subject to any disclaimer, the term of this patent is extended or adjusted under 35 U.S.C. 154(b) by 0 days.

(21) Appl. No.: 17/675,577

(22) Filed: Feb. 18, 2022

(51) Int. Cl.
*G07C 9/00* (2020.01)

(52) U.S. Cl.
CPC ..... *G07C 9/00309* (2013.01); *G07C 9/00571* (2013.01)

(58) Field of Classification Search
None
See application file for complete search history.

(56) References Cited

U.S. PATENT DOCUMENTS 8,621,230 B2 * 12/2013 Nachtigall ..... G06F 21/31 713/184
9,252,951 B1 * 2/2016 Katzer ..... G07C 9/00571
2008/0077798 A1 * 3/2008 Nachtigall ..... G06F 21/34 713/184
2019/0044727 A1 * 2/2019 Scott ..... H04L 9/3239
2019/0102962 A1 * 4/2019 Miller ..... G07C 9/00309

* cited by examiner

*Primary Examiner* — Carlos Garcia
(74) *Attorney, Agent, or Firm* — Bodman PLC

(57) ABSTRACT

An access control system includes a verification computing system that stores access rights information and credential proxies received from user devices, receives from a local access control subsystem an input credential and input credential proxy derived therefrom and received from a present user, identifies the access rights information associated with the user according to the input credential proxy and the stored credential proxy, requests and receives a stored credential from the user device of the present user, and compares the stored credential to the input credential to authorize the present user. The access rights information is for each of the users to access spaces with the local access control subsystems. The stored credential proxies are derived from stored credential received by the user devices using an algorithm. The input credential proxies are derived from the input credentials using the algorithm.

20 Claims, 15 Drawing Sheets

ACCESS CONTROL SYSTEMS, DEVICES, AND METHODS THEREFOR

CROSS-REFERENCE TO RELATED APPLICATION(S)

None.

TECHNICAL FIELD

The present disclosure relates to access control systems and, in particular, access control systems that electronically authorize users.

BACKGROUND

Access control systems for physical and computing spaces permit or deny access to persons seeking access thereto. Conventional access control systems may, for example, permit access upon entry of a pin code with a key pad or a password without any other verification or security provisions. Thus, an unauthorized person may be able gain access if they were to acquire the pin code or password. Other access control systems, such as two-factor authentication systems used with computing spaces, require multiple inputs from the user each time the user seeks access to the computing space, such as entry of a password and subsequent entry of a randomly generated code or response to a prompt. It would be advantageous to provide access control systems having both greater security than conventional systems and simplified user experiences.

SUMMARY

Disclosed herein are implementations of access control systems, devices, and methods thereof. In an implementation, an access control system includes a verification computing system that stores access rights information, stores stored credential proxies received from user devices in or for association with the access rights information, receives from a local access control subsystem an input credential and input credential proxy derived therefrom and received from a present user, identifies the access rights information associated with the user according to the input credential proxy and the stored credential proxy, requests and receives a stored credential from the user device of the present user, and compares the stored credential to the input credential to authorize the present user. The access rights information is for each of the user to access spaces with the local access control subsystems. The stored credential proxies are derived from stored credential received by the user devices using an algorithm. The input credential proxies are derived from the input credentials using the algorithm.

In an implementation, a method for providing access control, which may be performed by a computing system, includes:

storing access rights records that include user identifying information of a user, a stored credential proxy of the user, space identifying information to which the user is permitted access, and time information for when the user is permitted access to the space;

receiving an input credential and an input credential proxy from a local access control subsystem associated with the space;

identifying one of the access rights records having one of the stored credential proxies that corresponds to the input credential proxy, space identifying information that corresponds to the local access control subsystem from which the input credential and the input credential proxy were received, and time information that corresponds to a current time;

requesting and receiving a stored credential from a user device associated with the user identifying information of the one access rights record;

comparing the stored credential with the input credential, and sending an authorization signal to the local access control subsystem according to the comparing of the stored credential with the input credential.

The stored credential proxies are irreversibly derived from the stored credential with an algorithm by user device associated with the users, and the stored credentials include identifying information of the users received by the user devices. The input credential includes identifying information of a present user received by the local access control subsystem, and the input credential proxy is irreversibly derived from the input credential with the algorithm by the local access control subsystem.

In an implementation, a non-transitory computer-readable medium stores instructions that, when executed by one or more processors of a computing system, causes the system to perform operations to effectuate the foregoing method.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1A:
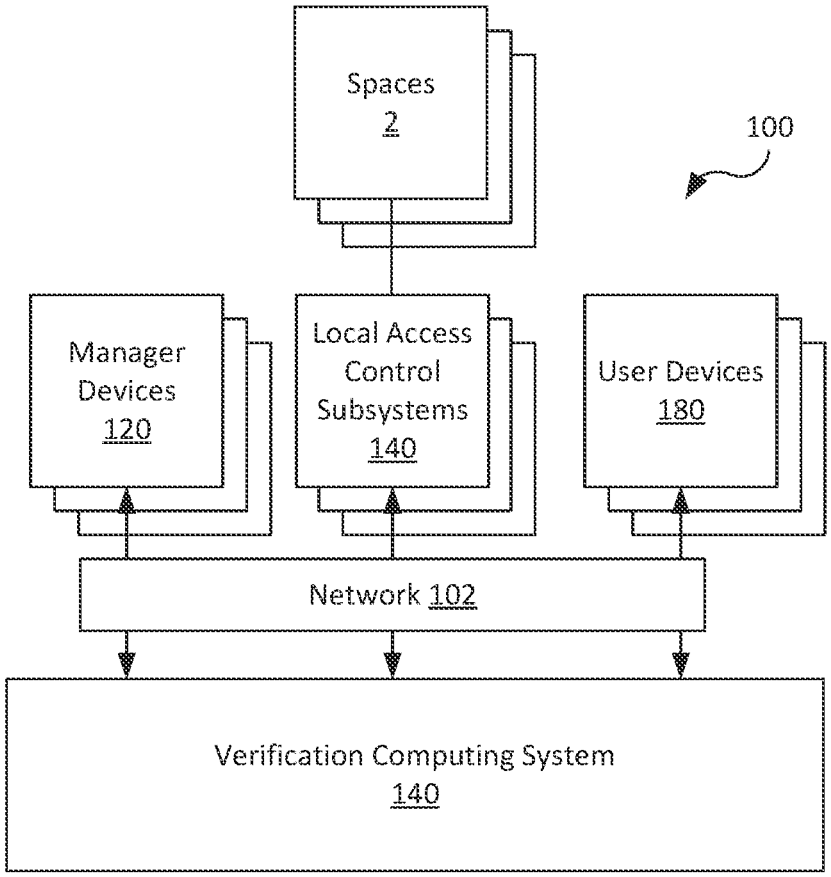
FIG. 1A is a schematic view of an access control system.

Referring to the figures, an access control system 100 is configured to authorize users to provide access to spaces to those users. If the user is authorized by the access control system 100, the access control system 100 permits access of the user to the space. If the user is not authorized by the access control system 100, the access control system 100 prevents access of the user to the space. The access control system 100 may be configured for use with spaces that are physical spaces (e.g., buildings, rooms, storage devices), computing spaces, and/or virtual spaces.

The access control system 100 utilizes user credentials and access rights. For a user seeking access to a space, which may be referred to as a present user, both the user credential and the access rights corresponding thereto are required to authorize the user for the physical space. A user credential is a form of identification presented by a user to the access control system 100 as proof, to a high degree of confidence, of the identity of the user (i.e., that the user is who they are presenting themselves to be). As non-limiting examples, the user credential may be biometric (e.g., facial recognition, voice recognition, finger print recognition, eye recognition), user-selected (e.g., pin code, pass word or phrase), a badge (e.g., RFID, or barcode), or a combination thereof (e.g., a pass phrase in the voice of the user). Access rights form an actionable record, which are input by a manager of a physical space for the user to access that space. For example, a manager may input access rights for a particular user to access a particular building in a particular range of time, such as a business owner (i.e., the manager) providing a worker (i.e., the user) permission to access an office building during normal business hours, or the owner of a vacation rental home (i.e., the manager) providing a tenant (i.e., the user) permission to access the vacation rental home during a rental period (e.g., a week).

The access rights may be accessible to or stored directly by a verification computing system. For example, the access rights may be stored in a blockchain. Other information, such as other information about the space, manager, or user may be stored on-chain (e.g., in the blocks with the access rights), in other blockchains, or off-chain (e.g., in a database by or accessible to the verification computing system). Blockchain storage is one manner in which the access rights may be stored securely to prevent unauthorized modification of the access rights. Blockchain storage of the access rights is discussed in further detail below. In another example, the access rights and other information may be stored one or more databases.

The verification computing system determines whether a user seeking access to one of the spaces is authorized both by determining whether access rights for the space are presently active for that user (i.e., date and time) and by verifying credentials, as discussed in further detail below.

For each of many users, one or more user credentials are stored by a user device associated with that user (e.g., a smartphone), which may be referred to as a stored credential. When a present user seeks access to a space, the present user inputs credentials to a local access control subsystem, which permits or denies access of the user to the space. User credentials input to the local access control subsystem may be referred to as input credentials. In an online or primary mode of operation, the input credential is sent to the verification computing system, which identifies any access rights for that space that may be associated with the input credential. The verification computing system then requests the input credential from the user device associated with the access rights, and compares the input credential and the stored credential to authorize the user. The verification computing system temporarily uses the stored credential and the input credential for the purposes of authorizing the user, and thereupon purges the stored credential and the input credential from memory thereof. In the online mode, the verification computing system does not otherwise store the stored credential or the input credential or have access thereto independent of the user device or the local access control subsystem.

In an offline or secondary mode of operation, the local access control subsystem may store the access rights and the stored credential, and itself compare the input credential and the stored credential to authorize the user. In the offline mode, the verification computing system may cause or directly transfer the stored input credential from the local access control subsystem, and thereupon purges the stored credential from memory thereof. In the offline mode, the verification computing system does not otherwise store or have access to the stored credential independent of the user device, and does not have access to or otherwise store the input credential.

Referring to FIG. 1A, the access control system 100 generally includes one or more manager devices 120, a verification computing system 140, one or more local access control subsystems 160, and one or more user devices 180.

Each of the manager devices 120 is associated with a manager of a space 2 and receives inputs of access rights information and user information from a manager of one or more local access control subsystems 160.

The verification computing system 140 receives the access rights from the manager device 120, stores or causes the access rights to be stored, and authorizes users by comparing user credentials received from the local access control subsystem 160 and the user device 180. The same or different computing devices of the verification computing system 140 may be used for storing the access rights and authorizing the users.

The local access control subsystems 160 are configured to both receive credentials from present users 18 seeking access to the space 2 associated therewith and permit or deny access of the present users 18 to the space 2. As referenced above, users credentials input by present users 18 to the local access control subsystems 160 are generally referred to herein as input credentials. In the case of the space 2 being a physical space, the local access control subsystem 160 may include a lock actuator that is operated to physically permit or deny access to the space 2. In the case of the space 2 being a computing space, the local access control subsystem 160 may permit or prevent access the computing space and/or features thereof (e.g., certain data and software thereof). The computing space may be or be provided by the user device 180, a computing space within the user device 180, and/or a remotely-operated computing space (e.g., a hosted desktop). In the case of the space 2 being a virtual space, such as within a virtual reality or augmented reality, the local access control subsystem 160 may permit or prevent access to such virtual spaces (e.g., augmented features for the present physical space and/or computer-generated environment). The space 2 is provided by a computing device, which may be or be provided by the user device 180 or another device.

Each of the user devices 180 receives and stores the user credentials from the user, and further sends the user credential to the verification computing system 140 when the user seeks access to the space. The user credentials received and stored by the user device 180 are referred to herein as the stored credentials. The user device 180 may not be in communication with the local access control subsystem 160.

The access control system 100 may be considered to include some but not other types of the systems and devices described herein, while still being in communication with those other types of systems or devices. For example, the access control system 100 may be considered to include the verification computing system 140, while being in communication but not including the manager devices 120, the local access control subsystems 160, and the user devices 180. In a still further example, the access control system 100 may be considered to include the verification computing system 140 and one or more of the local access control subsystems 160, while being in communication with but not including the manager devices 120 or the user devices 180.

Referring to FIGS. 1B-1E, the access control system 100 is configured to authorize users 18 by comparing an input credential 161*a* (i.e., that received by the local access control subsystem 160 when a present user 18 seeks access to the space 2) and a stored credential 181*a* (i.e., that previously input by the user 18 and stored by the user device 180).

Figure 1B:
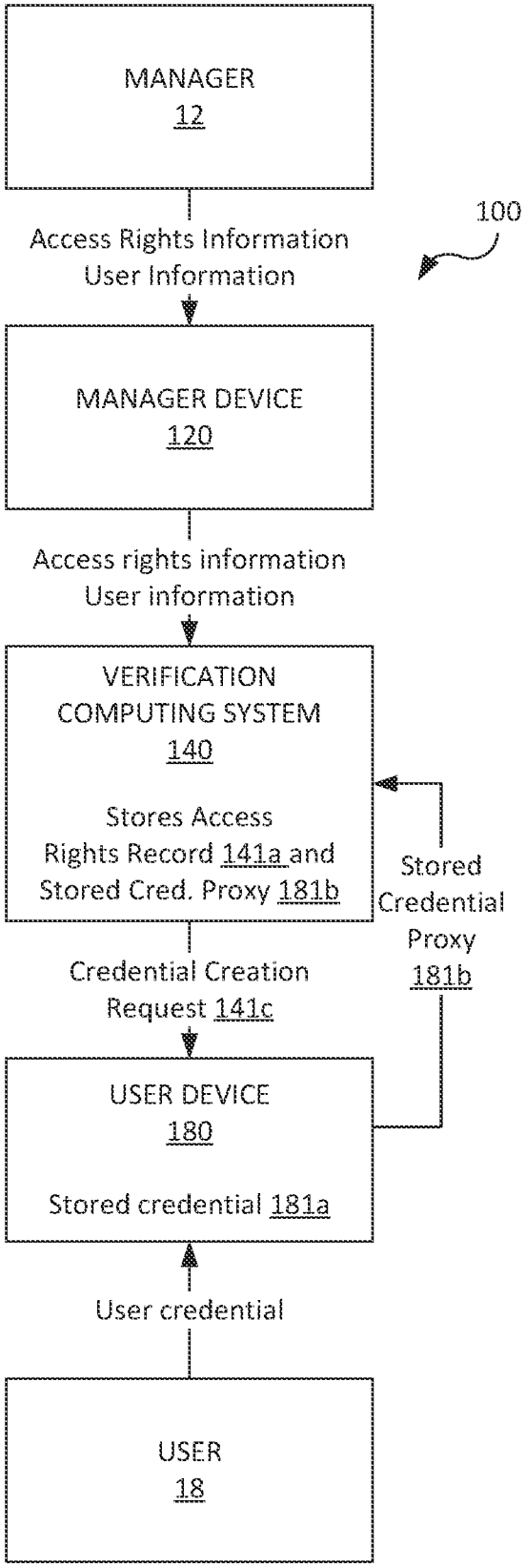
FIG. 1B is a functional diagram of the entry authorization system receiving and storing access rights and user information for user verification in an online mode.

First referring to FIG. 1B, to create access rights records 141*a*, the manager 12 inputs access rights information and user information for a user 18 via the manager device 120. The access rights information may further include information pertaining to whether the user authorization is to occur in the primary or online mode (i.e., in which case the verification computing system 140 compares the input and stored credentials) or the secondary or offline mode (i.e., in which case local access control subsystem 160 compares the input and stored credentials).

The user information and access rights are sent to and stored (or caused to be stored) by the verification computing system 140. For example, as referenced above, the access rights may be stored using blockchain. A blockchain functions as a ledger of access rights granted to the users. For example, each access rights record may include identifying information of the user (e.g., a user identifier), the stored credential proxy 181*b* of the user, identifying information of the space 2 and/or the local access control subsystem 160 associated therewith (e.g., a space identifier or a subsystem identifier), and the access rights granted to the user (e.g., time information, such as the dates, times, hours, or proxies or codes thereto, for when the user has been granted permission to access the space). Each access rights records may further include other information, such as a time stamp, other permissions, and/or contact information of the user. The time stamp may indicate a time at which the access rights were input for the user and be used to distinguish between current and superseded access rights records. For example, when access rights are changed for a given user to a given space, a later access rights record may include different access rights (e.g., revoking, reducing, increasing, or otherwise modifying access rights) than an earlier access rights record and supersede that earlier access rights record by having a later time stamp. Other permissions may, for example, include permission for the user to grant access rights to another user (e.g., another family member for a vacation rental home). Each block in the blockchain may include multiple access right records (e.g., thousands). The contact information may be conventional contact information (e.g., a phone number) or another manner by which signals may be sent to the user device 180 of the user.

Instead of blockchain storage, access rights record 141*a* may be stored in one or more databases.

Other information pertaining to the space 2, the local access control subsystems 160, the manager 12, and the user 18 may be stored separately from the access rights records 141*a*, such is in other blockchains or other databases. Space records may, for example, include other information pertaining to the space 2, such as spatial and/or access relationship to other spaces 2, information identifying the local access control subsystems 160 associated therewith, information identifying the manager 12 associated therewith, and/or user access logs. Local access control subsystem records may, for example, include information about the local access control subsystems 160 (e.g., types of credentials accepted thereby), spaces 2 associated therewith, information identifying the manager 12 thereof, and/or user access logs. Manager records may, for example, include information about the manager 12 (e.g., name, contact information), information identifying the spaces 2 associated therewith and managed thereby, and/or information identifying the local access control subsystems 160 associated therewith and managed thereby. User records may, for example, include identifying information about the user (e.g., a user identifier), user information (e.g., name, contact information), information about the user device 180 associated therewith (e.g., type of user device, credentials accepted thereby), and/or stored credential proxies 181*b* (as discussed in further detail below).

Upon receipt of the access rights and user information, or upon creation of the access rights record 141*a*, the verification computing system 140 sends a credential creation request 141*c* to a user device 180 of the user to install a user device application (discussed in further detail below) and create a user credential.

Still referring to FIG. 1B, the user 18 inputs a user credential via the user device 180, which is stored by the user device 180 as the stored credential 181*a*. The user device 180 generates a credential proxy, which may be referred to as the stored credential proxy 181*b*. A credential proxy and is a numerical value or other code irreversibly derived by an algorithm from a credential using a suitable algorithm (e.g., a one-way hash). For example, the stored credential proxy 181*b* is derived from the stored credential 181*a*. The user device 180 sends the stored credential proxy 181*b* to the verification computing system 140, which stores the stored credential proxy 181*b* for later use to identify access rights for users 18 seeking access to spaces 2. With the stored credential proxy 181*b* being irreversibly derived from the stored credential, the user credential (e.g., the stored credential 181*a*) cannot be derived or otherwise generated from the simplified stored credential. The credential proxy may also be referred to as a credential proxy value (CPV), credential verification value (CVV), or credential verification code.

Figure 1C:
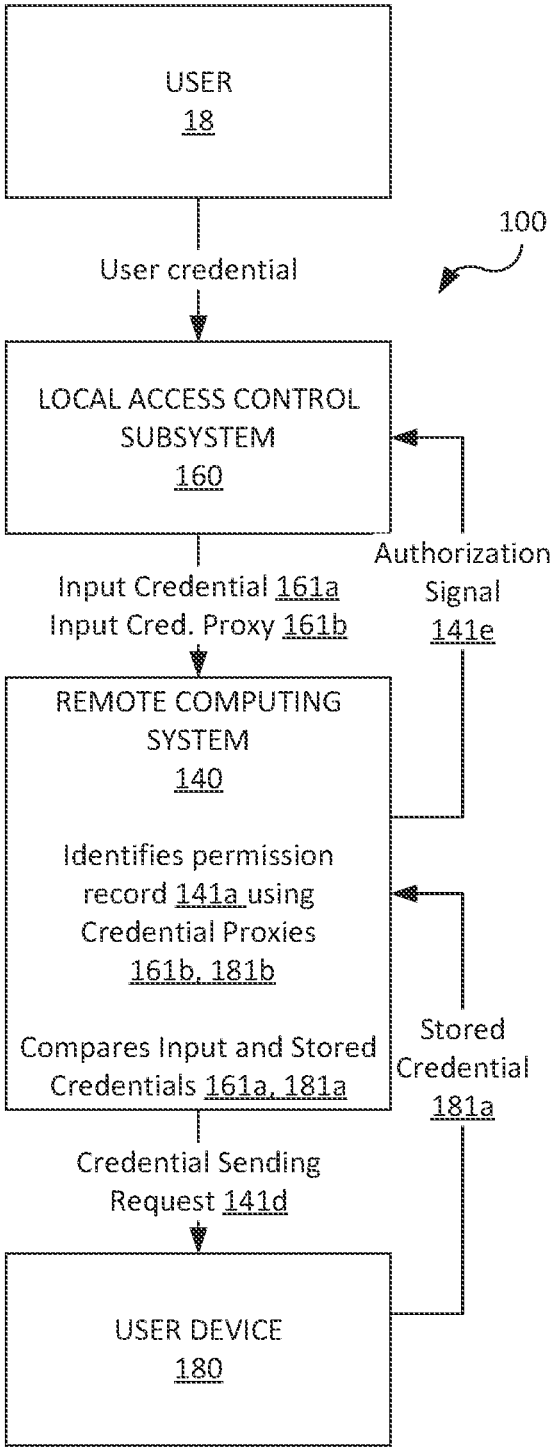
FIG. 1C is a functional diagram of the entry authorization system authorizing a user in the online mode.
Figure 1D:
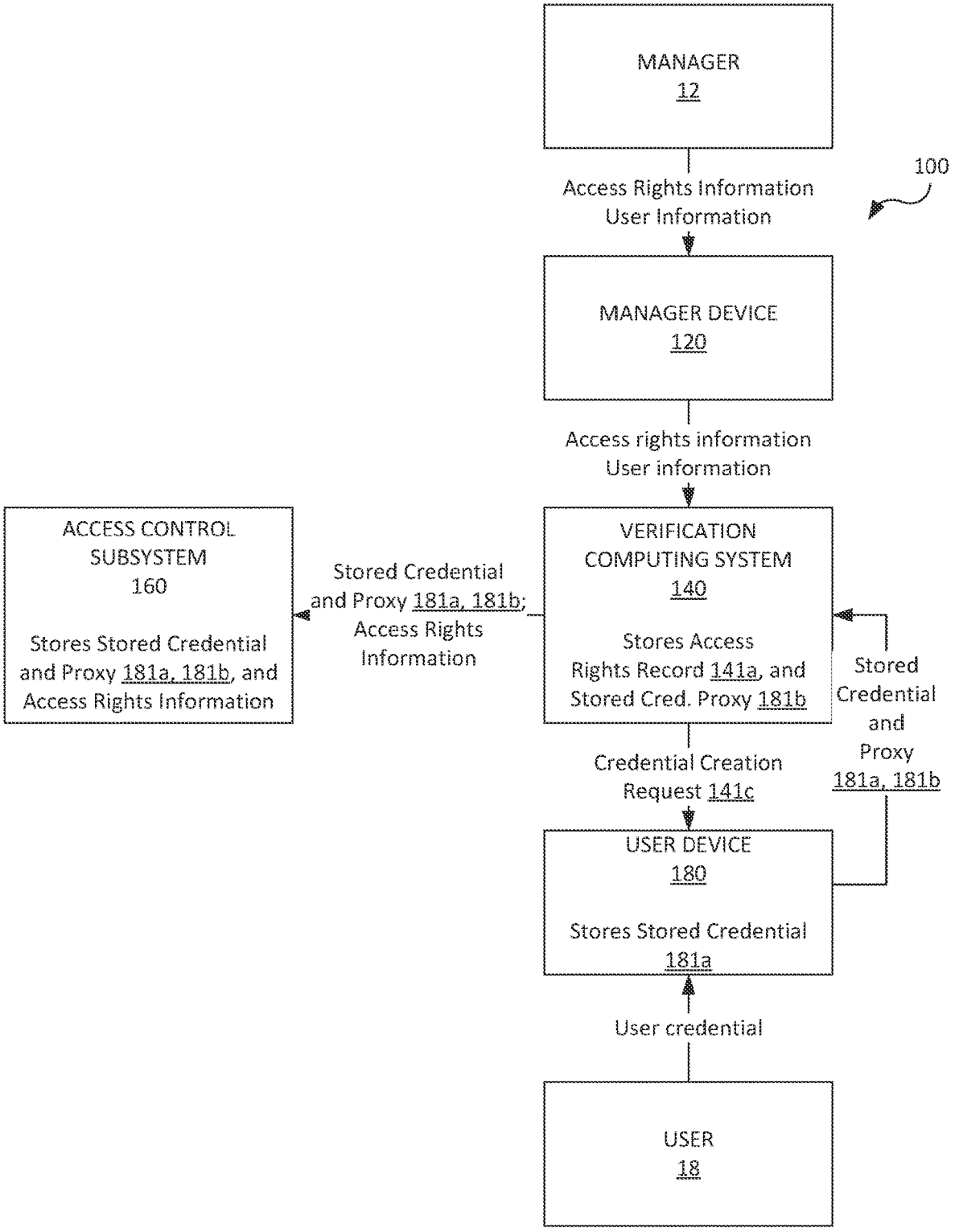
FIG. 1D is a functional diagram of the entry authorization system receiving and storing access rights and user information for user verification in an offline mode.

As shown in FIG. 1D, in the case of the offline mode, the user device 180 additionally sends the stored credential 181*a* to the verification computing system 140, which in turn sends the stored credential 181*a*, the stored credential proxy

181*b*, and the access rights information (e.g., date and/or times) to the local access control subsystem 160 for storage thereby.

Referring to FIG. 1C, to authorize a present user 18 in the primary or online mode, the user 18 inputs a user credential to the local access control subsystem 160, which forms the input credential 161*a* and is sent by the local access control subsystem 160 to the verification computing system 140. The local access control subsystem 160 also generates another credential proxy, which is referred to as the input credential proxy 161*b*, and is irreversibly derived from the input credential 161*a* using the same algorithm from which the stored credential proxy 181*b* was derived from the stored credential 181*a*. The input credential proxy 161*b* is sent, along with the input credential 161*a*, to the verification computing system 140.

The verification computing system 140 identifies access rights records 141*a* for the local access control subsystem 160 using the input credential proxy 161*b*. For example, the verification computing system 140 may identify a user record in which the stored credential proxy 181*b* matches the input credential proxy 161*b*, then identify access rights records 141*a* having the same user identifier as the user record. Alternatively, the access rights records 141*a* may include the stored credential proxy 181*b* in which case the access rights record 141*a* may be identified directly by having a stored credential proxy 181*b* that matches in the input credential proxy 161*b*. Upon identifying the access rights record 141*a* for the user, the verification computing system 140 sends a credential sending request 141*d* to the user device 180 of the user 18 of the access rights record 141*a* requesting the stored credential 181*a*. The user device 180 then sends the stored credential 181*a* to the verification computing system 140, which then compares the stored credential 181*a* to the input credential 161*a* to authorize the user 18.

In response to the comparison of the stored credential 181*a* and the input credential 161*a*, the verification computing system 140 sends an authorization signal 141*e* to the local access control subsystem 160 according to which the local access control subsystem 160 permits or denies entry of the user 18. If the comparison is favorable between the stored credential 181*a* and the input credential 161*a*, the authorization signal 141*e* indicates that the user is authorized, and the local access control subsystem 160 permits access of the user 18 to the space 2 (e.g., by operating or permitting operation of a lock actuator in the case of the space 2 being a physical space). If the comparison is unfavorable between the stored credential 181*a* and the input credential 161*a*, the authorization signal 141*e* indicates that the user is not authorized, and the local access control subsystem 160 denies entry of the user 18 (e.g., by not operating or permitting operation of the lock actuator in the case of the space 2 being a physical space).

The verification computing system 140 temporarily utilizes the user credentials for user authorization and thereafter purges the user credentials (i.e., the stored credential 181*a* and the input credential 161*a*), but does not thereafter store the user credentials or any other information from which user credentials may be derived.

Figure 1E:
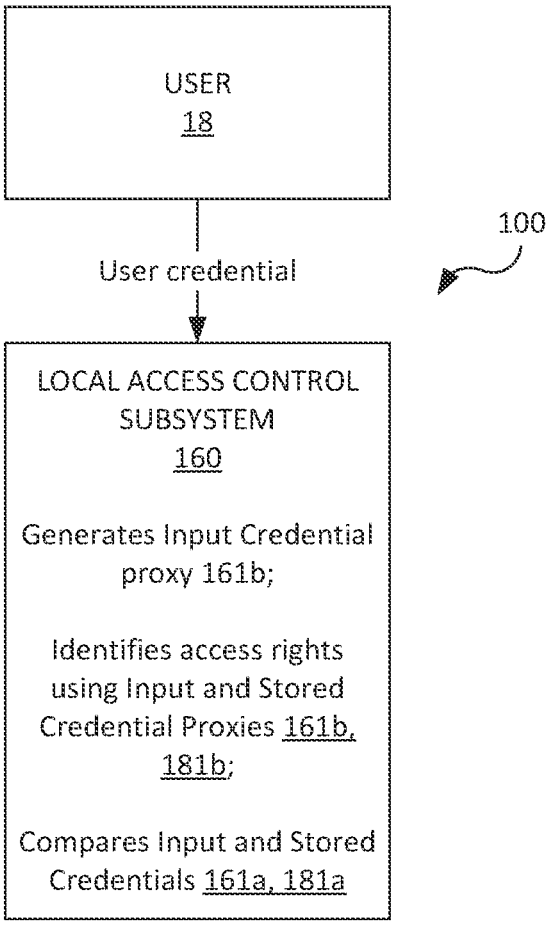
FIG. 1E is a functional diagram of the entry authorization system authorizing a user in the offline mode.

Referring to FIG. 1E, in the case of the offline mode, the local access control subsystem 160 itself, rather than verification computing system 140, identifies the access rights stored therein using the stored credential proxy 181*b* and the input credential proxy 161*b*, then compares the stored credential 181*a* (stored thereby) to the input credential 161*a* (received thereby) to authorize the user.

Further details of the operations of the access control system 100, including the manager device 120, the verification computing system 140, the local access control subsystem 160, and the user device 180 are discussed below.

Figure 2:
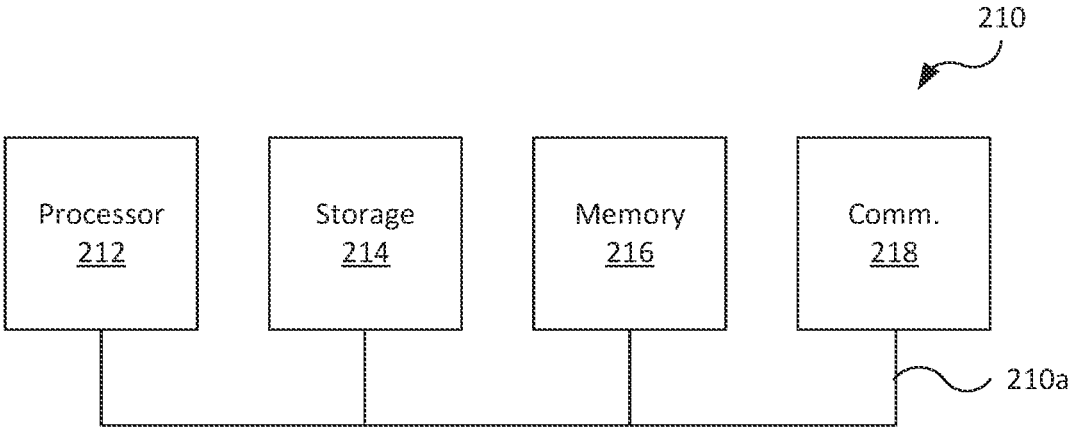
FIG. 2 is a schematic view of an example hardware configuration of a controller.

Referring to FIG. 2, a schematic of a non-limiting example of a hardware configuration for a controller 210, which may be used in or form the manager device 120, the verification computing system 140, the local access control subsystem 160, and/or the user device 180. The controller 210 is generally configured to execute instructions to operate the various devices and systems to perform the functions and methods described herein. It should be noted, however that the controller 210 may be configured in any other suitable manner, for example, including other hardware components and/or other controllers 210. The controller 210 generally includes one or more processors 212, a storage 214, a memory 216, a communications interface 218, and a bus 210*a* by which the other components of the controller 210 are in communication with each other. The processor 212 may be any suitable processing device, such as a central processing unit (CPU), configured execute the stored instructions. The storage 214 is a non-volatile, long-term storage device, such as a hard disc or solid state storage device capable of storing the instructions executed to be executed by the processor 212 (e.g., software programming) and other information and data. The storage 214 may be considered a non-transitory machine- or computer-readable medium that stores instructions executed by the one or more processors 212. The memory 216 is a short term, volatile storage device, such as a random access memory (RAM) module. The communications interface 218 is configured to send signals from and receive signals to the controller 210 from other components of the devices or systems into which the controller 210 is incorporated.

Figure 3A:
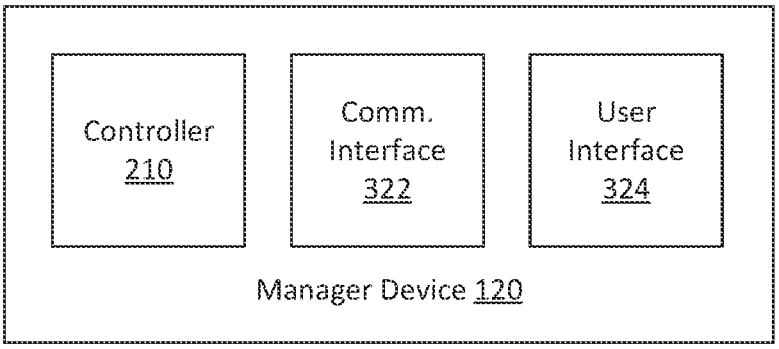
FIG. 3A is a schematic view of an example hardware configuration of a manager device of the entry authorization system.
Figure 3B:
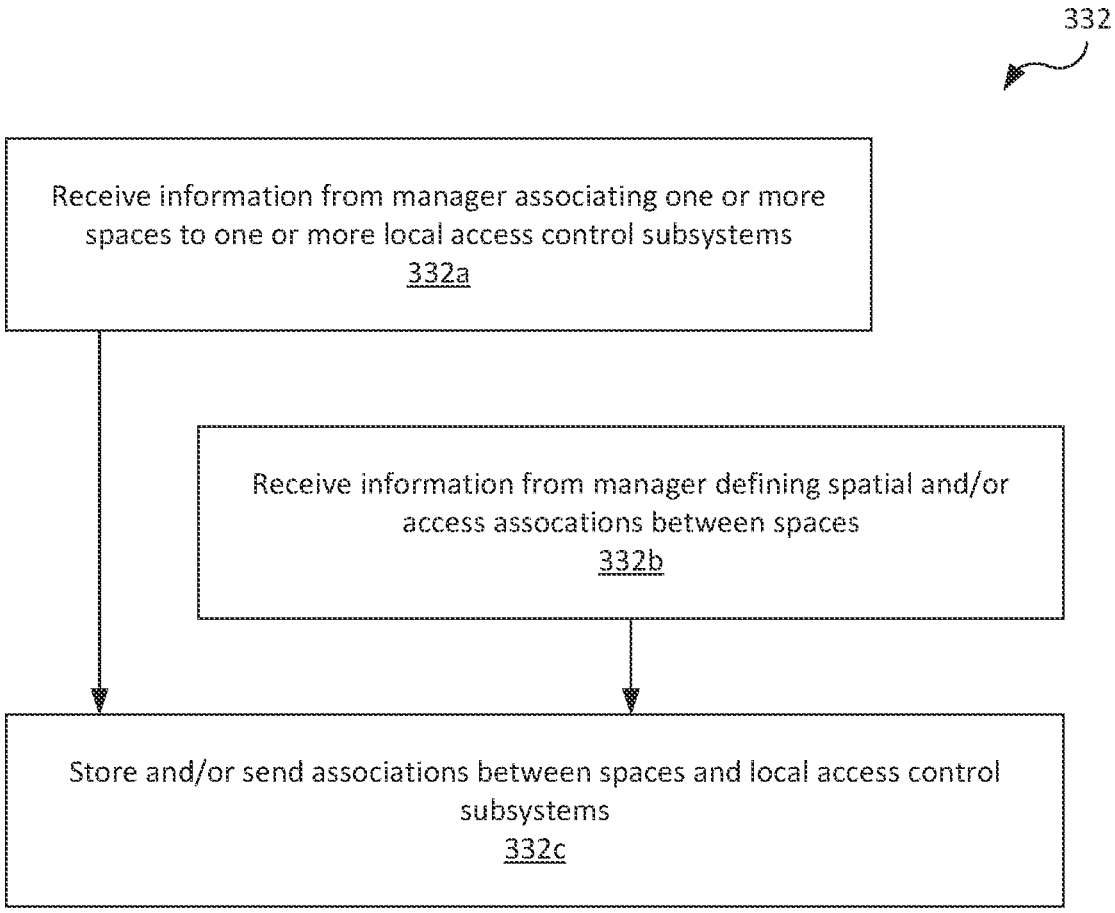
FIG. 3B is a flowchart of a method for associations between spaces and local access control subsystems with the manager device.
Figure 3C:
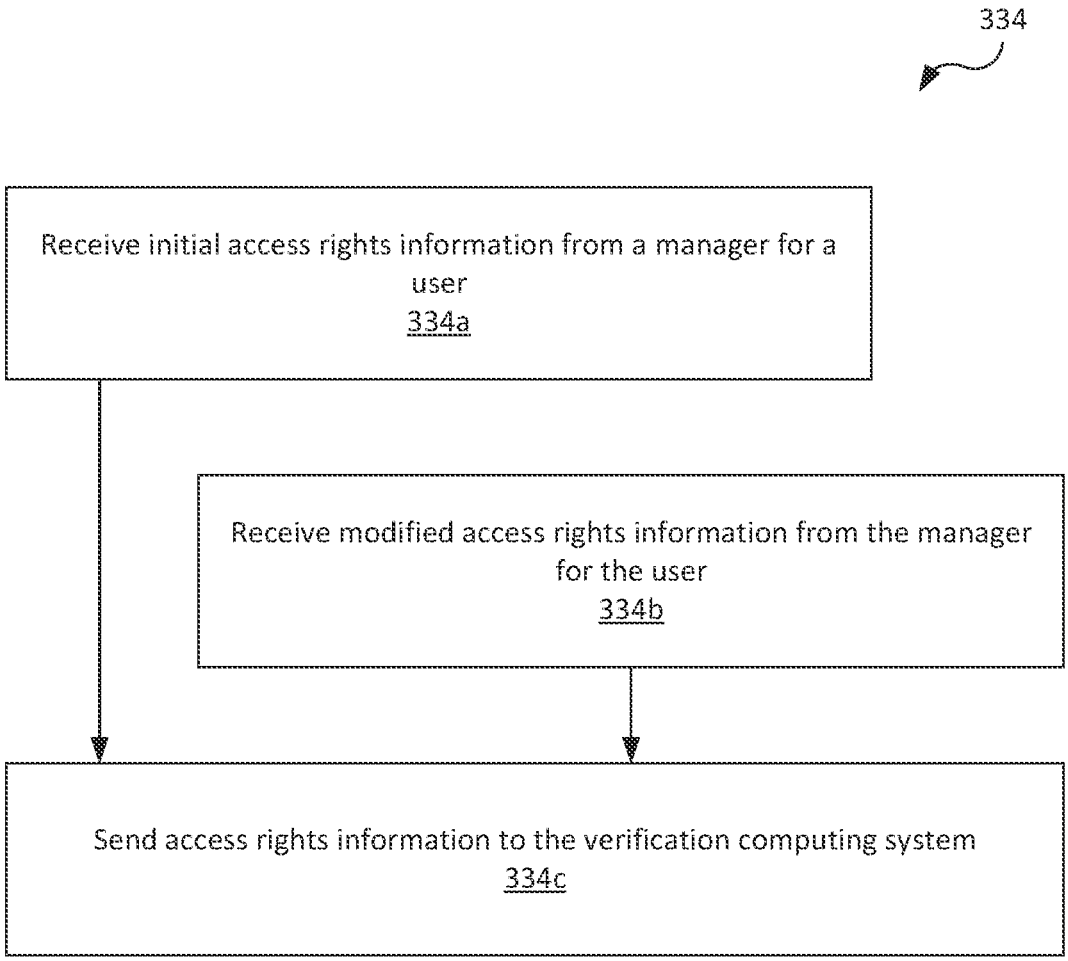
FIG. 3C is a flowchart of a method for receiving access rights information with the manager device.

Referring to FIGS. 3A-3C, the manager device 120 is configured for the manager 12 to input access rights for a given user 18 for a given space 2, and may also be configured for the manager 12 to perform various functions related to the local access control subsystems 160.

Referring to FIG. 3A, the manager device 120 may, for example, be a smartphone or other portable or home computing device, which includes the controller 210, a communications interface 322, a user interface 324, and a power source (not shown). The controller 210, as described previously, includes the processor 212, the storage 214, the memory 216, and the communications interface 218, the processor 212 executing instructions contained in the storage 214. The communications interface 322 includes suitable hardware configured to send and receive signals to and from other devices and subsystems of the access control system 100 directly (e.g., the local access control subsystem 160) or indirectly (e.g., via the network 102). The power source stores and/or receives power for operating the other components of the manager device 120.

The user interface 324 is configured to receive inputs from and provide outputs to the user thereof (i.e., the manager 12). The user interface 324 includes, for example, a touch screen for outputting visual information and receiving inputs, buttons for receiving inputs, a speaker for receiving audio inputs, a camera for receiving visual inputs, and a speaker for providing audio outputs.

Referring to FIGS. 3B-3C, the manager device 120 is configured to perform various methods related to access rights and the local access control subsystems 160 and includes one or more sets of instructions for performing the methods. The manager device 120 may perform a first method 332 for associating spaces 2 and the local access control subsystems 160 with each other, and a second method 334 for receiving and transmitting access rights information.

Referring to FIG. 3B, the first method 332 performed with the manager device 120 generally includes a first block 332*a* at which associations between local access control subsystems 160 and space 2 are received, a second block 332*b* at which associations between the spaces 2 are received, and a third block 332*c* at which the associations are stored and/or sent to the verification computing system 140.

At the first block 332*a*, the manager device 120 receives and stores inputs from the manager 12 associating different local access control subsystems 160 with one or more spaces 2 and/or access points thereof, such as with the user interface 324 (e.g., a touch screen). For example, the manager 12 may associate the local access control subsystem 160 with the space 2 and/or access points thereof by inputting to the manager device 120 names of the spaces 2, access points thereto, and/or of the local access control subsystem 160 (e.g., building address, "Front Entrance", "Rear Entrance") and/or inputting fielded information (e.g., address, floor, room number).

At the second block 332*b*, the manager device 120 receives and stores inputs from the manager 12 associating different spaces 2 and/or access points with each other. For example, the manager 12 may spatially associate the different spaces 2 as being connected (e.g., accessible via each other) via one or more access points to which local access control subsystems 160 are associated. The manager 12 may instead or additionally define access rights rules between the different spaces 2 and/or access points. For example, access rights to a first space (e.g., a storage space) within a second space (e.g., a building containing the storage space) dictates that the user also have access rights to the second space (e.g., the building), while access rights to the second space (i.e., the building) does not dictate that the user also have access rights to the first space (i.e., the storage space within the building).

At the third block 332*c*, the manager device 120 stores the associations received in the first block 332*a* and the second block 332*b* and/or sends the associations to the verification computing system 140 for storage thereby.

Referring to FIG. 3C, the second method 334 performed with the manager device 120 generally includes a first block 334*a* at which initial access rights information is received, a second block 334*b* at which modified access rights information is received, and a third block 334*c* at which the access rights information is sent to the verification computing system 140.

At the first block 334*a*, the manager device 120 receives initial access rights information from the manager (e.g., via the user interface 324 thereof). The access rights information includes space information, time information, and user information. The space information identifies the particular space 2 and/or the particular local access control subsystem 160 for which the manager 12 is granting access rights to the user 18. The space information may be a unique identifier or name assigned by the manager to the space 2 and/or the local access control subsystem 160 (e.g., that received at the first block 332*a* of the first method 332). The space information may further include different types of information pertaining to the local access control subsystem 160, including types of credentials accepted thereby (e.g., facial recognition, speech recognition, voice recognition, and/or pin codes) and whether the local access control subsystem 160 operates in the primary and/or secondary modes of operation (i.e., online or offline).

The access rights information also includes time information, which defines the times at which a particular user is being granted permission to access the space 2. The time information may, for example, include a start date, a start time, an end date, an end time, day limitation (e.g., weekdays), hours limitation (e.g., business hours only), an indefinite indication, and/or proxies thereto.

The user information includes user contact information (e.g., phone number, email address) for the user 18 to which the manager 12 is granting access rights. The user information may further include the name of the user and/or a unique identifier of the user.

The access rights information may also include whether the local access control subsystem 160 is to be operated in the primary mode with online verification or in the secondary mode with offline verification.

At the second block 334*b*, the manager devices 120 receives changes to the access rights information and/or user information from the manager 12. For example, the manager 12 may revoke, reduce, or extend access rights for the user. The manager device 120 sends the changes to the access rights information to the verification computing system 140.

At the third block 334*c*, the manager devices 120 sends (e.g., via the communications interface 322) the access rights information to the verification computing system 140, which as described in further detail below, creates, stores, and updates access rights records 141*a* according thereto.

Figure 4A:
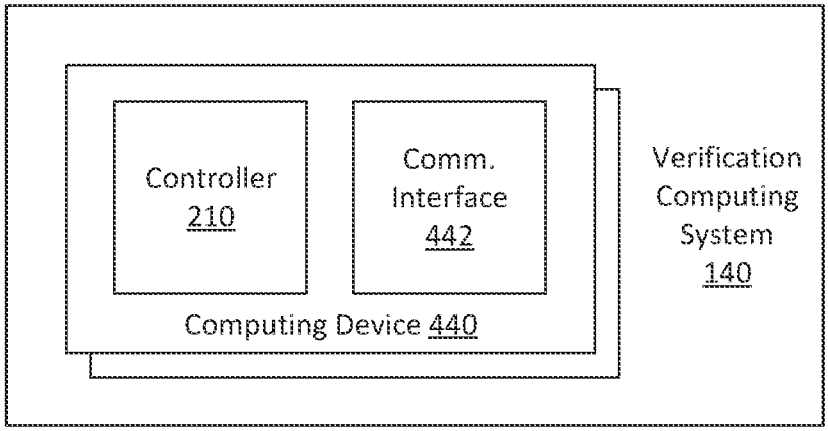
FIG. 4A is a schematic view of an example hardware configuration of a verification computing system of the entry authorization system and computing devices thereof.
Figure 4B:
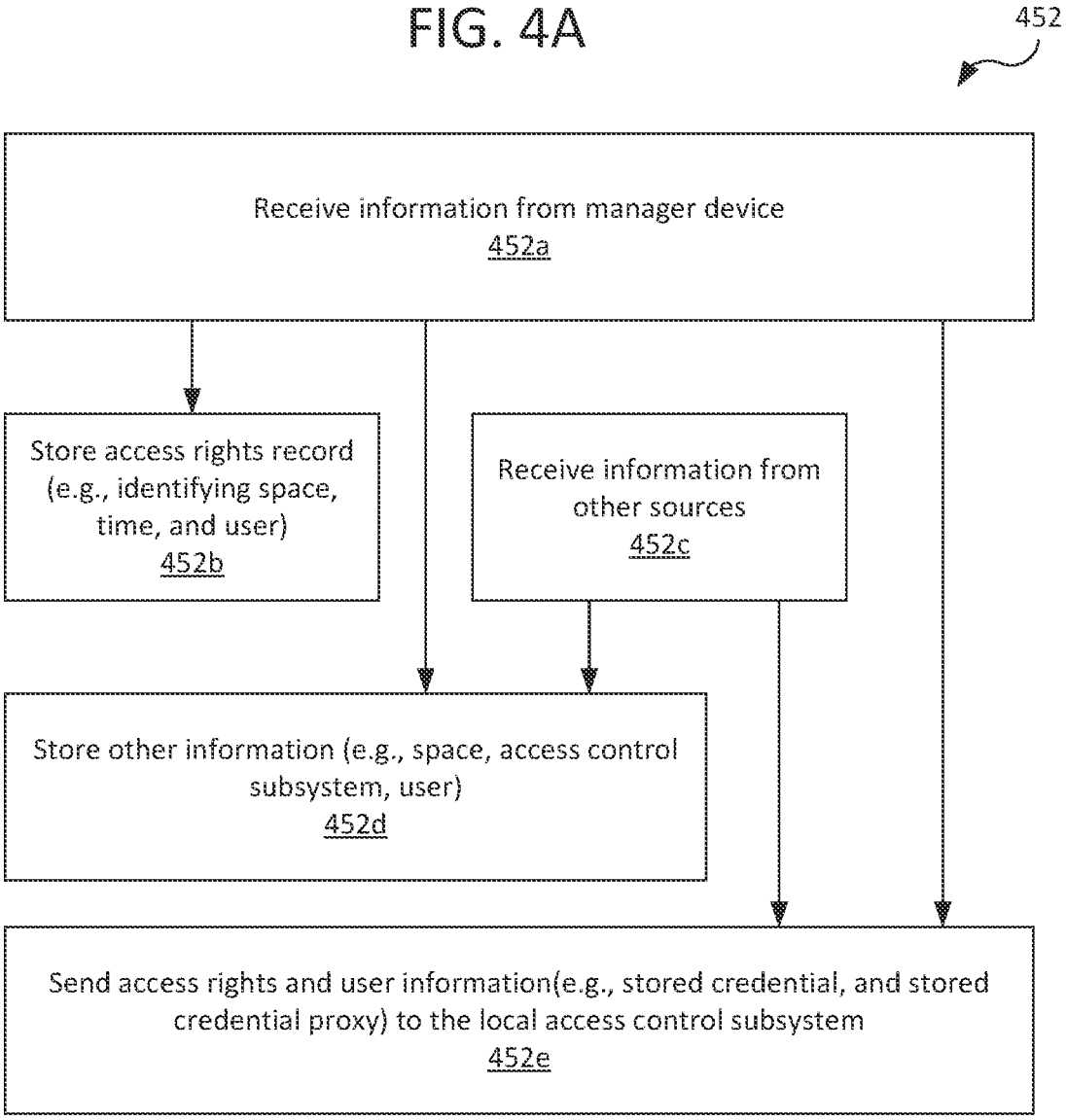
FIG. 4B is a flowchart of a method for receiving information and storing access rights records and other information with the verification computing system.
Figure 4C:
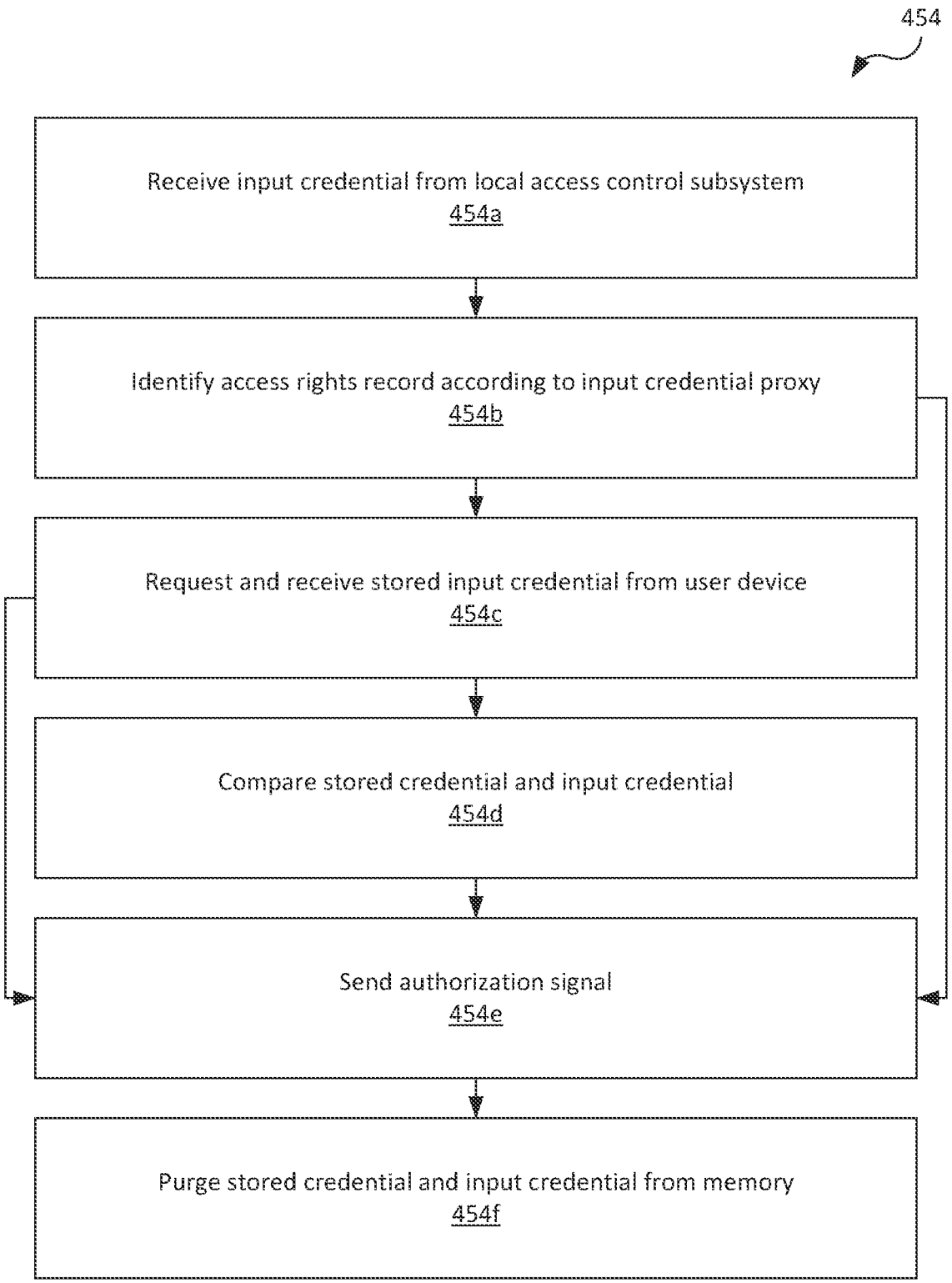
FIG. 4C is a flowchart of a method for verifying users with the verification computing system.

Referring to FIGS. 4A-4C, the verification computing system 140 is configured to store access rights records 141*a*, store other information, and perform user verification to authorize users attempting to access the space 2 via the local access control subsystem 160.

Referring to FIG. 4A, the verification computing system 140 is a computing system in communication with the manager devices 120, the local access control subsystems 160, and the user devices 180 (e.g., via the network 102). The verification computing system 140 includes one or more computing devices 440 (e.g., server computers) in communication with each other (e.g., via the network 102 and/or a local network). Each of the computing devices 440 of the verification computing system 140 may have a hardware configuration as shown in FIG. 4A and may, for example, include one or more of the controllers 210, a communications interface 442, and a power source (not shown). The controllers 210 of the computing devices 440 may be as described previously. The communications interface 442 may be as described previously for the communications interface 322 of the manager device 120 (e.g., including suitable hardware configured to communicate with the other devices and systems described herein, such as via the network 102).

Each of the computing devices 440 may be configured to perform the same and/or different subsets of the functions and methods described herein.

Referring to FIGS. 4B and 4C, the verification computing system 140 performs one or more methods, which may include a first method 452 for receiving and storing information and a second method 454 for verifying users. The verification computing system 140 includes one or more sets of instructions (e.g., applications) that are executed individually or cooperatively by the computing devices 440 of the verification computing system 140 to perform the first method 452 and the second method 454.

Referring to FIG. 4B, the first method 452, which may be referred to as an access rights and information storage method, generally includes a first block 452*a* at which information is received from the manager device 120, a second block 452*b* at which access rights records 141*a* are stored, a third block 452*c* at which information is received from other sources, and a fourth block 452*d* at which other information is stored for association with the access rights.

At the first block 452*a*, the verification computing system 140 receives information from the manager device 120, which may occur at a single time or multiple different times. The information may include access rights information, information about the spaces 2, information about the local access control subsystem 160, and/or the user 18.

The access rights information includes identifying information for the space 2 (e.g., an identifier of the space 2 and/or one or more of the local access control subsystem 160 associated therewith), time information (i.e., dates and/or time at which the user 18 is permitted by the manager 12 to access the space 2), and information identifying the user (e.g., contact information and/or another identifier for the user 18).

The information about the spaces 2 may, in addition to the identifying information, include the spatial and/or access relationships between different ones of the spaces 2 (e.g., spaces 2 that are accessible via one another, or one space 2 is accessible only via one of the spaces 2) and/or the associations of the local access control subsystems 160 associated with the different spaces 2 (e.g., controlling access to or between spaces 2). The information about the local access control subsystems 160 may include associations with the different spaces 2 and/or the types of credentials receivable by the local access control subsystems 160. The information about the user 18 may, in addition to the identifying information, include the name and/or other contact information about the user. Additional information about the local access control subsystem 160 and/or the user 18 may be received from other sources, such as the local access control subsystem 160 and/or the user device 180.

At the second block 452*b*, one or more of the access rights records 141*a* are stored. As referenced above, the access rights records 141*a* may be stored in a database by the verification computing system 140 or a blockchain system of the verification computing system 140. In the example of a database, the access rights record 141*a* may be stored on one of the computing devices 440. Each of the access rights records 141*a* may include the user identifying information, the stored credential proxy of the user, the space identifying information for the space 2 to which the user 18 is being granted access (e.g., a space identifier or an identifier of the local access control subsystem 160), time information for when the user 18 is granted permission to access the space 2, other permissions and/or a time stamp corresponding to when the access rights were received. In the database, the access rights records may be revised and/or deleted as access rights for a given user for a given space are changed (e.g., revoked, reduced, increased, or otherwise changed).

In the example of a blockchain system, the access rights records 141*a* are stored in blockchains. Different ones of the computing devices 440 of the verification computing system 140 form nodes, which are in communication with each other (e.g., via local networks or the network 102). The blockchains of the access rights records 141*a* are distributed and stored by each of the nodes, and require consensus among the nodes before appending the blockchains to add, delete, or update the access rights records 141*a* thereof. The nodes are formed by the different computing devices 440 that may, for example, be associated with different actors having involvement or other interest in the access control system 100, such as the managers 12 (e.g., having large numbers of the local access control subsystems 160 and/or the users 18), manufacturers of the local access control subsystems 160, and/or platform providers (e.g., a third party providing services to which the managers 12 and/or the manufacturers subscribe). In one example, the nodes are formed by different computing devices 440 of a service provider.

A blockchain forms a ledger of the access rights records 141*a*. Each block of the blockchain includes the multiple of the access rights records 141*a* (e.g., thousands). Each of the access rights record 141*a* may, for example, include user identifying information (e.g., a user identifier), a stored credential proxy for the user (i.e., of the type of credential corresponding to that of the local access control system 160), space identifying information (e.g., a space identifier for the space 2 or a subsystem identifier for the local access control system 160 associated with the space 2), and time information (i.e., the dates and times at which the user 18 is being granted permission to access the space 2). As referenced above, each of the access rights records 141*a* may further include a time stamp for when the access rights were input and/or when the access rights records 141*a* was created, which may be used to distinguish between a current access rights record 141*a* that supersedes a previous access rights records 141*a* for a given user 18 to a given space 2 (e.g., due to changes in the access rights (e.g., revocation, reduction, increase, or other change). The access rights record 141*a* may further include other permissions granted to the user 18 (e.g., to grant access rights to other users). The access rights records 141*a* may further include user contact information according to which signals may be sent to the user device 180 of the user 18. Each new block of the blockchain includes different access rights records 141*a*, some of which may supersede previous access rights records 141*a* stored in an earlier block (e.g., for the same user for the same space).

The access rights records 141*a* may be stored in other data structures in a database or in blockchains, for example, including different and/or additional information being stored therein and/or for association therewith.

At the third block 452*c*, the verification computing system 140 receives information from other sources, which may include information from the local access control subsystems 160 and/or the user devices 180. Information from the local access control subsystems 160 may, for example, include information about the local access control subsystems 160, such as the types of credentials acceptable thereby. Information from the user devices 180 may, for example, include further information about the user (e.g., name and other contact information, types of credentials accepted by the user device 180, types of the stored credentials 181*a* stored by the user device 180, and/or the stored credential proxies 181*b* themselves).

At the third block 452*c*, the verification computing system 140 may send requests to other devices to initiate other action and/or request the other information. For example, upon receiving access rights information from the manager device 120 or creating an access rights record 141*a* for a new user 18, the verification computing system 140 may send a credential creation request 141*c* (e.g., a text message or other signal) to the user device 180 prompting the user to download and install a user device application. Upon receiving additional access rights for the user 18, the verification computing system 140 may send further credential creation requests 141*c* (e.g., text messages or other signal to the user device application) prompting the user to input different types of credentials required for the local access control subsystems 160 for which they are being granted access rights.

At the fourth block 452*d*, the verification computing system 140 stores the other information in or for association with the access rights records 141*a*. For example, upon receiving the stored credential proxy 181*b* from the user device 180, the stored credential proxy 181*b* is stored in the access rights record 141*a* (or in a new one of the access rights records 141*a* that supersedes a previous one of the access rights records 141*a* for the same user for the same space). Instead or additionally, the other information may be stored so as to associate the access rights records 141*a* with the users 18 when creating new access rights records 141*a* and/or when the users 18 seek access to one of the spaces 2. For example, the verification computing system 140 may store the other information in manager records, space records, local access control subsystem records, and/or user records. The manager records may, for example, include information about the manager (e.g., name, contact information), identification and other information about the spaces 2 managed thereby, and/or identification and other information about the local access control subsystems 160 managed thereby. The space records may, for example, include identification information about the spaces 2, information about each of the different spaces 2, such as identifying information and/or the spatial and/or access relationships therebetween, and/or identification information of the local access control subsystems 160 associated therewith. The local access control subsystem records may, for example, include identification information of the local access control subsystems 160, identification and other information about the managers 12 and/or the spaces 2 associated therewith, the types of credentials received thereby, identifiers and/or other information about the access rights records 141*a* associated therewith, and/or identifiers and/or other information about the users 18 that have been granted access rights (e.g., the stored credential proxies 181*b* corresponding to the users 18 having access rights). The user records may, for example, include identification information about the users 18 (e.g., a unique user identifier), other information about the user (e.g., name, other contact information), the types of credentials receivable by the user device 180, the types of the stored credentials 181*a* already stored by the user device 180, the stored credential proxies 181*b* themselves, and identifying or other information about the access rights records 141*a* associated therewith.

The other information may be stored in any suitable manner, for example, in databases (as referenced above) by the computing devices 440 of the verification computing system 140, which may be different computing devices 440 than those forming the nodes.

The method 452 may also include a fifth block 452*e* at which the verification computing system 140 sends information to the local access control system 160 (e.g., with the communications interface 442 of the computing devices 440). In particular, when the access rights are for the offline mode, the verification computing system 140 sends the access rights information (e.g., dates, time, users), stored credential 181*a*, and the stored credential proxy 181*b* to the local access control system 160 that may later authorize users 18 directly with such information and without the verification computing system 140.

Referring to FIG. 4C, the second method 454, which may be referred to as user verification method, is performed to verify the user 18 (e.g., a present user) seeking access to one of the spaces 2 via the local access control subsystem 160 associated therewith. The second method generally includes comparing the input credential 161*a* (then received by the local access control subsystem 160 and sent to the verification computing system 140) and the stored credential 181*a* (previously stored by and sent from the user device 180 to the verification computing system 140).

The second method 454 generally includes a first block 454*a* at which the input credential 161*a* and the input credential proxy 161*b* are received from the local access control subsystem 160, a second block 454*b* at which the access rights records 141*a* are identified according to the input credential proxy 161*b* and the stored credential proxy 181*b*, a third block 454*c* at which the stored credential 181*a* is requested and received, a fourth block 454*d* at which the credentials 161*a*, 181*a* are compared, a fifth block 454*e* at which authorization signals 141*e* are sent, and a sixth block 454*f* at which the input credential 161*a* and the stored credential 181*a* are purged.

At the first block 454*a*, the verification computing system 140 receives the input credential 161*a* and the input credential proxy 161*b* from the local access control subsystem 160 upon receipt thereby from the user 18. For example, the receiving may be performed by the communications interface 442 of one of the computing devices 440. The computing devices 440 may be different than those forming any nodes by which block chains are stored. Receipt and processing of the input credential 161*a* by the local access control subsystem 160 is discussed in further detail below.

The input credential 161*a* and the input credential proxy 161*b* of the present user 18 may be in a secure form (e.g., encrypted) in which case the input credential 161*a* and the input credential proxy 161*b* are processed (e.g., decrypted) to be in a usable form. As an alternative to receiving both the input credential 161*a* and the input credential proxy 161*b*, the verification computing system 140 may receive only the input credential 161*a* and itself generate the input credential proxy 161*b* therefrom.

At the second block 454*b*, the verification computing system 140 (e.g., the controller 210 of one or more of the computing devices 440) identifies any access rights records 141*a* according to the input credential proxy 161*b*. For example, as described above, the ledger formed by the blockchain or the database may be searched for those access rights records 141*a* that includes identifying information for the space associated with the local access control subsystem 160 from which the input credential proxy 161*b* was received (e.g., the space identifier or the subsystem identifier), includes the stored credential proxy 181*b* that matches the input credential proxy 161*b*, and that is active (i.e., the current time is within the time information of the access rights record 141*a*).

At the third block 454*c*, the verification computing system 140 requests and receives the stored credential 181*a* from the user device 180. For example, the verification computing system 140 sends a credential sending request 141*d* (e.g., a signal with the communications interface 442) to the user device 180 indicated in the user records for the user 18 or which may be. The credential sending request 141*d* may identify a particular one or type of multiple stored credentials 181*a* that may be stored by the user device 180 and which match the type of input credential 161*a* received by the local access control subsystem 160. The stored credential 181*a* may be in a secured format (e.g., encrypted) in which case the stored credential 181*a* is further processed (e.g., decrypted) to be in a usable format.

At the fourth block 454*d*, the verification computing system 140 compares the stored credential 181*a* (i.e., received from the user device 180) with the input credential 161*a* (i.e., received from the local access control subsystem 160). The verification computing system 140 (e.g., the controller 210, such as the processor 212) may compare the stored credential 181*a* and the input credential 161*a* in any suitable manner for that type of credential. For example, if a pin code, the verification computing system 140 may perform the comparison by determining whether the stored credential 181*a* and the input credential 161*a* are exact matches. In the cases of biometric credentials, the verification computing system 140 may perform the comparison by determining similarity between the stored credential 181*a* and the input credential 161*a*.

At the fifth block 454*e*, the verification computing system 140 sends an authorization signal 141*e* that indicates whether or not the present user 18 seeking access is authorized and according to which the local access control subsystem 160 permits or denies access to the user 18. For example, authorization signal 141*e* indicates that the user 18 is not authorized if at the second block 454*b* no access rights records 141*a* are identified according to the input credential proxy 161*b*, if at the third block 454*c* no stored credential 181*a* is received, or if at the fourth block 454*d* the stored credential 181*a* and the input credential 161*a* are unfavorably compared (e.g., do not match or do not meet similarity standards). The authorization signal 141*e* instead indicates that the user 18 is authorized if the stored credential 181*a* and the input credential 161*a* are favorably compared (e.g., match or meet similarity standards).

In the case of the space 2 being a computing space or a virtual space, the authorization signal 141*e* is sent to the computing device providing such space, which may be the user device 180 as described previously.

At the sixth block 454*f*, the stored credential 181*a* and the input credential 161*a* are purged from the verification computing system 140 (e.g., the storage 214 and/or the memory 216 of the controller 210 thereof).

Referring to FIGS. 5A-5D, the local access control subsystem 160 includes suitable hardware that performs one or more methods in order to permit or deny access to users 18 seeking access to a space 2.

Figure 5A:
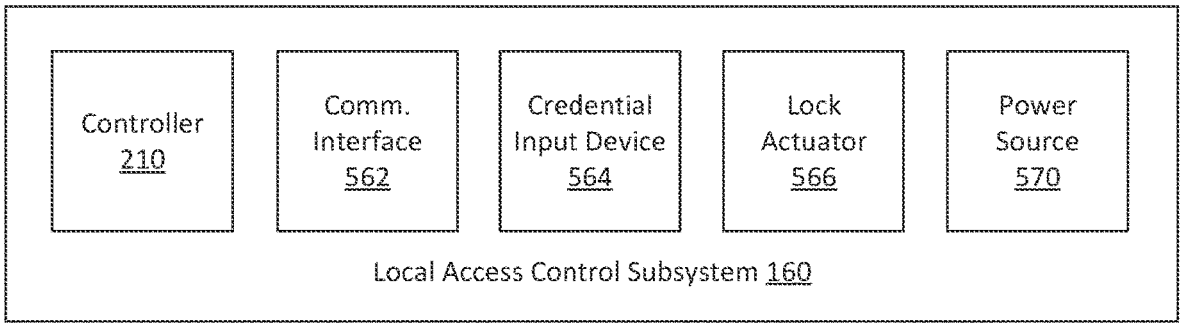
FIG. 5A is a schematic view of a local access control subsystem of the entry authorization system.
Figure 5B:
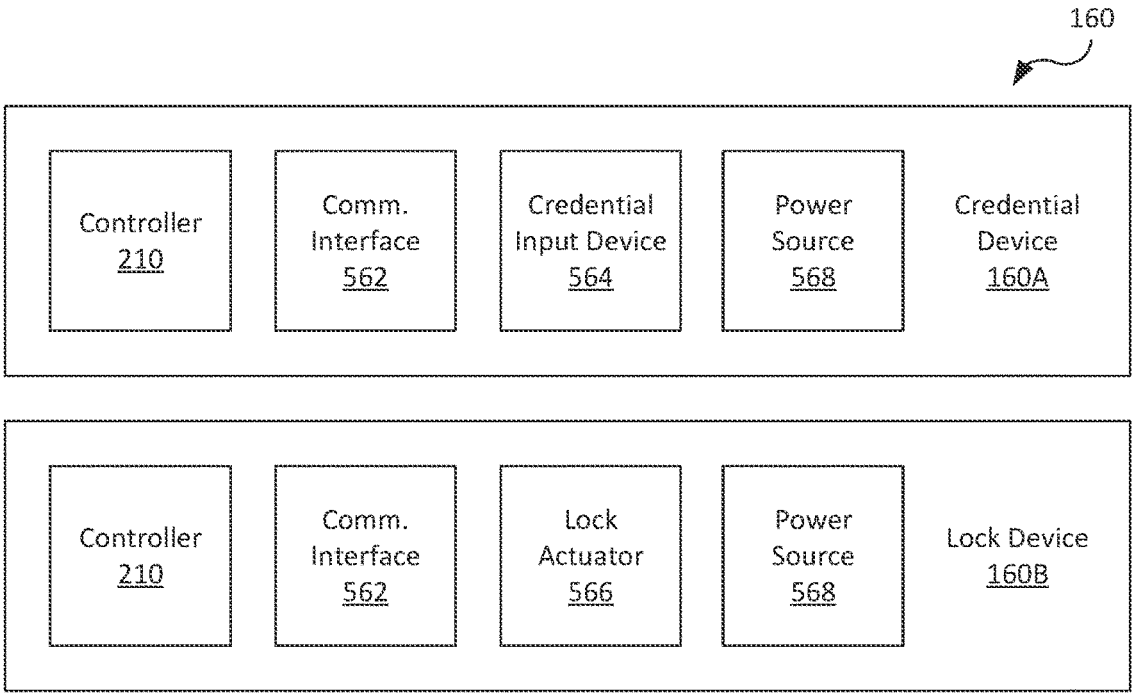
FIG. 5B is a schematic view of an alternative embodiment of the local access control subsystem.

Referring additionally to FIGS. 5A-5B, in the case of the space 2 being a physical space, each of the one or more local access control subsystems 160 generally includes one of more of the controllers 210, one or more communications interfaces 562, a credential input device 564, a lock actuator 566, and one or more power sources 568. As shown in FIG. 5A, the local access control subsystem 160 may be provided as a singular device that includes the controller 210, the communications interface 562, the credential input device 564, the lock actuator 566, and the power source 568. Alternatively, as show in FIG. 5B, the local access control subsystem 160 may be include separate physical devices, such as a first or credential device 160A including the credential input device 564 and a second or lock device 160B including the lock actuator 566, with both such devices including one of the controllers 210, one of the communications interfaces 562, and one of the power sources 568.

The controller 210 is a computing device, which may have the hardware configuration described previously or another suitable configuration, configured to operate the local access control subsystem 160 according to stored instructions, including the communications interface 562, the credential input device 564, and the lock actuator 566.

The communications interface 562 is configured to communicate with the verification computing system 140. For example, the communications interface 562 includes suitable hardware configured to communicate with the verification computing system 140 according to any suitable protocols and with any intervening devices (e.g., via Wi-Fi to the network 102). In the case of the local access control subsystem 160 including the credential device 160A and the lock device 160B as separate devices, the communications interface 562 of the credential device 160A may be configured to communicate with the verification computing system 140 (e.g., via Wi-Fi and the network 102) and the lock device 160B (e.g., via Bluetooth), while the communications interface 562 of the lock device 160B may be configured to communicate with only that of the credential device 160A but not the verification computing system 140 without the credential device 160A.

The credential input device 564 is configured to receive user credentials from the users 18. As referenced above, each user credential is a form of identification the user 18, which may be biometric, user-defined, or a combination thereof. The credential input device 564 is configured to receive as inputs of one or multiple different types of credentials. In one example, the user credential is facial recognition in which case the credential input device 564 includes appropriate sensors and other devices for obtaining facial data as the input credentials, for example, including structured light and/or time-of-flight sensors (e.g., including an infrared camera with an infrared illuminator and/or dot projector) and/or a visible light camera and appropriate processing hardware for analyzing the facial data (e.g., generating point cloud data). In another example, the credential is a fingerprint in which case the credential input device 564 includes appropriate sensors for obtaining fingerprint data as the input credentials (e.g., optical, capacitive, or ultrasonic). In another example, the credential is a pass word or phrase defined by the user and in which case the credential input device 564 includes a microphone for obtaining speech data and appropriate processing hardware for analyzing the speech data (e.g., running speech to text software). In a still further example, the credential as input code defined by the user and in which case the credential input device 564 includes or otherwise provides a keypad (e.g., a physical keypad or a touch screen configured to display a virtual keypad). In a still further example, the credential includes a combined pass phrase defined by the user and voice recognition of the user in which case the credential input device 564 includes a microphone for obtaining speech and voice data and appropriate processing hardware for both analyzing the speech data (e.g., as described above) and voice data (e.g., determining voice characteristics). Further still, the credential may be a physical badge or electronic key (e.g., RFID, bar code) that the credential input device 564 is configured to read and/or communicate with. With each different type of credential, the credential input device 564 includes appropriate processing hardware for analyzing the credential, which may be a dedicated processing device or be the controller 210.

The lock actuator 566 is configured to operate and/or may include a physical lock, for example, of a door to a building, region of the building, room of a building, or storage device (e.g., cabinet). The lock actuator 566 may, for example, be configured as or include a deadbolt operator that is configured to operate a deadbolt lock (not shown or labeled) as operated by the controller 210. The lock actuator 566 may, for example, include an electric motor and suitable mechanism (e.g., gears, shafts, and/or linkages) for operating the lock.

The power source 568 is configured to provide power to the other components of the local access control subsystem 160, for example, including batteries or being coupleable to a power source of the building. In the case of the local access control subsystem 160 including the credential device 160A and the lock device 160B, the power source 570 of the credential device 160A may be that of the building, while the power source 570 of the lock device 160B may include batteries (e.g., if coupled to and moving with the door).

In the case of the space 2 being a computing space or a virtual space, the local access control system 160 omits the lock actuator 566, for example, being configured as a portable or home computing device (e.g., as described for the user device 180 below). The computing device of the local access control system 160 may be or otherwise provide the computing space or the virtual space or may be a separate computing device. In some examples, the local access control subsystem 160 may be formed or otherwise provided by the user device 180.

Figure 5C:
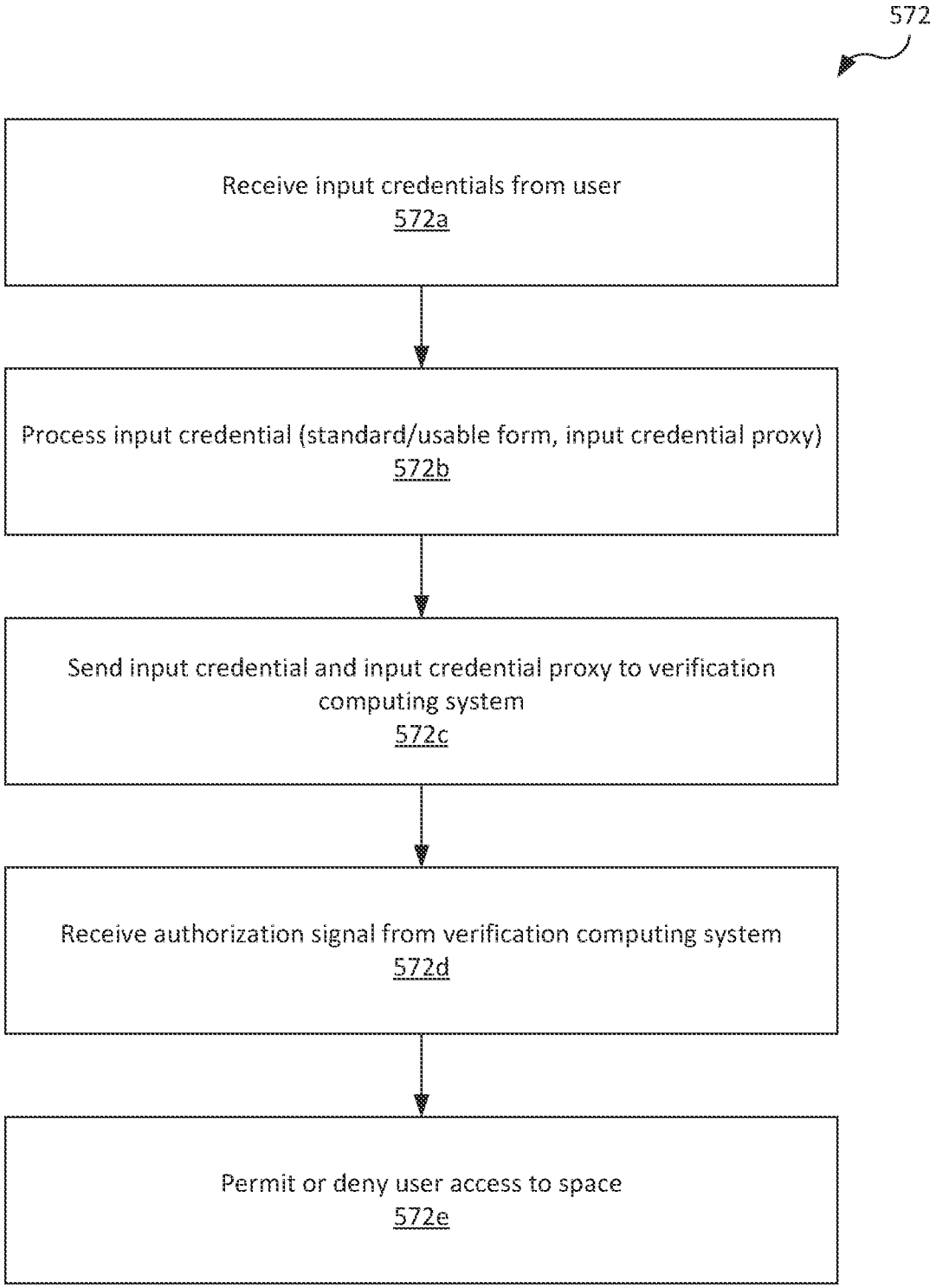
FIG. 5C is a flowchart of a first (online) method for permitting or denying access of users to spaces with the local access control subsystem.
Figure 5D:
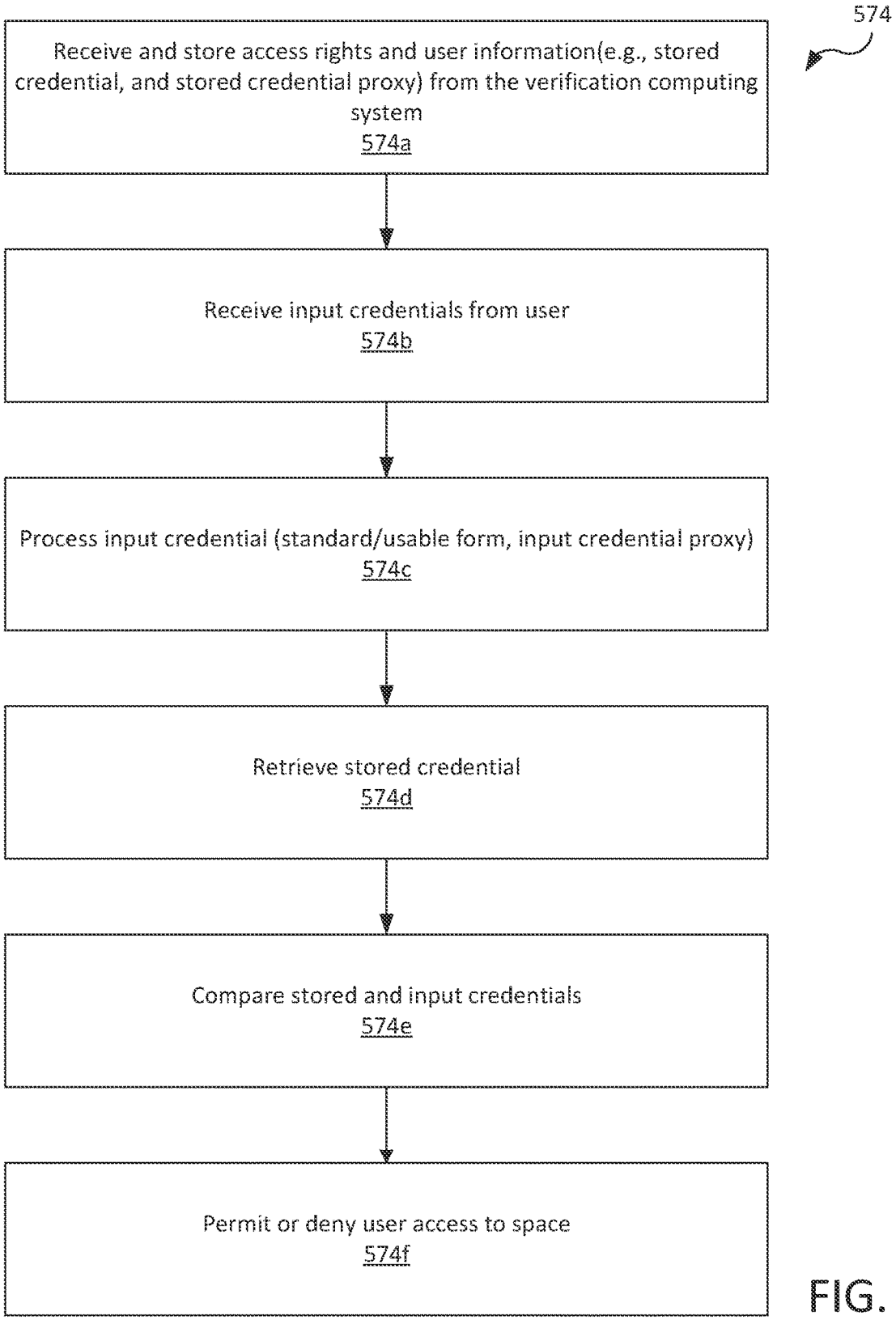
FIG. 5D is a flowchart of a second (offline) method for permitting or denying access of users to spaces with the local access control system.

Referring to FIG. 5C, the local access control subsystem 160 is configured to perform a method 572 (e.g., an online or connected method) and/or a method 574 (e.g., an offline or disconnect method) for permitting access of a user 18 to a space 2. The local access control subsystem 160 includes one or more sets of instructions (e.g., software or applications) that are executed individually or cooperatively by the controller 210 of the local access control subsystem 160 to perform the method 572 and/or the method 574.

The method 572 generally includes a first block 572*a* at which input credentials are received from present user, a second block 572*b* at which the input credential are processed, a third block 572*c* at which the input credential 161*a* and the input credential proxy 161*b* are sent, a fourth block 572*d* at which authorization signals 141*e* are received, and a fifth block 572*e* at which access to the space 2 is permitted or denied to the user 2.

At the first block 572*a*, the local access control subsystem 160 receives the input credential 161*a* (e.g., receives credential information) from the present user 18. For example, the controller 210 operates the credential input device 564 to receive or otherwise collect information (e.g., facial data, speech data, voice data, passcodes) by operating the various sensors thereof.

At the second block 572*b*, the local access control subsystem processes the credential information, both to represent the input credential 161*a* in a standard or otherwise usable form and to generate the input credential proxy 161*b*.

The credential information is processed to represent the input credential 161*a* in a standard or otherwise usable form (e.g., for comparison to the stored credential 181*a*), which may be a numerical expression derived from the credential data received by the credential input device 564. For example, in the case of facial or other biometric data, the controller 210 may process the biometric data (e.g., point cloud and/or feature measurements) to generate a numerical or other representation of the biometric of the user to form the input credential 161*a*. In the case of the speech data, the controller 210 may process the speech data to recognize or otherwise identify specific words or phrases spoken by the user that form the input credential 161*a*. In the case of voice data, the controller 210 may process the voice data (e.g., audio with frequency characteristics) to generate a numerical or other representation of the voice of the use to form the input credential 161*a*. In the case of a physical badge or electronic key, a numeric or alphanumeric code may be obtained therefrom.

As may be appropriate, the input credential 161*a* is processed to be in a standard or otherwise usable format for comparison by the verification computing system 140 to the stored credential 181*a*. It should be noted that the credential input device 564 may utilize different hardware components and/or otherwise collect the credential information differently, which may require that the input credential 161*a* and the stored credential 181*a* be processed to be in the standard format for comparison. Alternatively, the verification computing system 140 may process the input credential 161*a* and/or the stored credential 181*a* (e.g., the data collected by the credential input device 564) to be in the standard format.

The input credential 161*a* is further processed to produce the input credential proxy 161*b*. More particularly, as referenced above, the input credential proxy 161*b* is irreversibly derived with a suitable algorithm (e.g., a one-way hash) from the input credential 161*a* into a form from which the input credential 161*a* cannot be derived from the input credential proxy 161*b*. Since the input credential proxy 161*b* is utilized to identify the access rights records 141*a* for that user (i.e., by searching for the stored credential proxy 181*b* for that user 18, as described above), for biometric-type credentials (e.g., facial recognition), the input credential proxy 161*b* may be derived from a portion of the input credential, such as those portions that may be more reliable or consistently measured (e.g., pupil distance in facial recognition, or central portions of fingerprints). As an alternative to the input credential proxy 161*b* being determined by the local access control subsystem 160, the verification computing system 140 may instead process the input credential 161*a* to determine the input credential proxy 161*b*.

The input credential 161*a* and the input credential proxy 161*b* may be further processed into secure forms (e.g., encryption).

At the third block 572*c*, the local access control subsystem 160 (e.g., the communications interface 562 as operated by the controller 210) sends the input credential 161*a* and the input credential proxy 161*b*, which may be in the secure forms, to the verification computing system 140.

At the fourth block 572*d*, the local access control subsystem 160 (e.g., via the communications interface 562 as operated by the controller 210) receives the authorization signals 141*e* from the verification computing system 140. As referenced above, the authorization signals 141*e* may indicate whether the verification computing system 140 determined the user to be authorized or not authorized.

In the case of the space 2 being a computing space or a virtual space, the computing device providing the space 2 receives the authorization signals 141*e*.

At the fifth block 572*e*, the local access control subsystem 160 permits or denies access to the present user 18 seeking access to the space 2. For example, the local access control subsystem 160 operates the lock actuator 566 with the controller 210 to physically permit or prevent access of the user to the space 2 associated therewith. If the authorization signal indicates that the user 18 is authorized, the controller 210 operates or permits the lock actuator 566 to be operated to actuate a lock to permit access of the user 18 to the space 2. In the case of permitting the lock actuator 566 to be operated, the controller 210 may be operated the lock actuator 566 in further response to another user input (e.g., a button press or other input command received by the local access control subsystem 160). If the authorization signal indicates that the user is not authorized, the controller 210 does not operate or permit the lock actuator 566 to be operated, so as to prevent access of the user 18 to the space 2. It should be noted, however, that if the authorization signal 141*e* does not authorize the user, secondary authorization may be implemented to authorize the user (e.g., subsequent receipt of the same or different input credentials 161*a*) and/or permit access (e.g., use of a physical key).

In the case of the space 2 being a computing or virtual space, the computing device providing the space 2 permits access to the data, applications, augmented features, and/or computer-generated environments provided thereby.

The method 574, for the offline mode, generally includes a first block 574*a* at which access rights information is received and stored, a second block 574*b* at which input credentials are received, a third block 574*c* at which the input credential are processed, a fourth block 574*d* at which access rights are identified, a fifth block 574*e* at which credentials are compared, and a sixth block 574*f* at which access is permitted or denied to the user.

At the first block 574*a*, the local access control subsystem 160 receives the access rights and user information (e.g., date, time, user identifier, stored credential 181*a*, stored credential proxy 181*b*) from the verification computing system 140. The access rights and user information may be stored in any suitable format in and/or for association with each other, such as in one or more databases (e.g., in the storage 214 of the controller 210 of the local access control subsystem 160).

At the second block 574*b*, the local access control subsystem 160 receives the input credential 161*a* from the user 18, as described for the first block 572*a* of the method 572.

At the third block 574*c*, the local access control subsystem 160 processes the input credential 161*a*, as generally described for the second block 572*b* of the method 572 for the input credential 161*a* to be in the standard or other usable form and to generate the input credential proxy 161*b*.

At the fourth block 574*d*, the local access control subsystem 160 retrieves the stored credential 181*a* for the user 18 from the access rights and user information stored thereby. For example, the local access control subsystem 160 may identify access rights stored thereon, which include the stored credential 181*a* and the stored credential proxy 181*b* stored in or for association therewith. The access rights and the stored credential 181*a* may be identified by finding access rights having a stored credential proxy 181*b* that matches the input credential proxy 161*b*.

At the fifth block 574*e*, the local access control subsystem 160 compares the stored credential 181*a* and the input credential 161*a* substantially as described above for the fourth block 454*d* of the method 454 at which the verification computing system 140 compares the stored credential 181*a* and the input credential 161*a*.

At the sixth block 574*f*, the local access control subsystem 160, according to the comparison, permits or denies the user 18 access to the space 2 as described above for the fifth block 572*e* of the method 572.

Figure 6A:
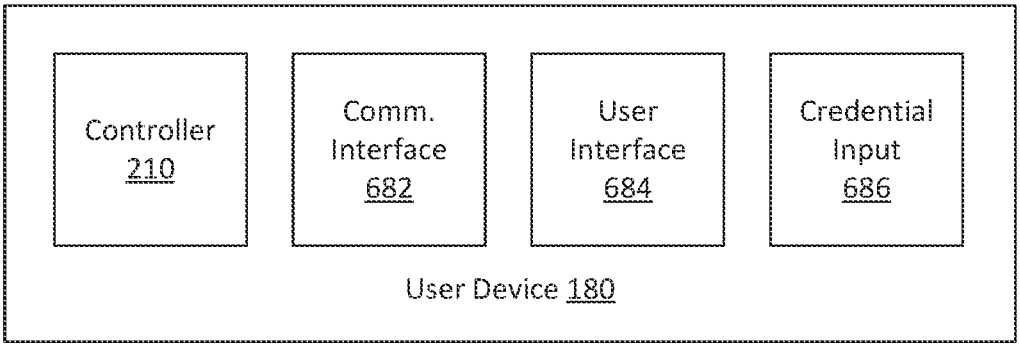
FIG. 6A is a schematic view of user device of the entry authorization system.
Figure 6B:
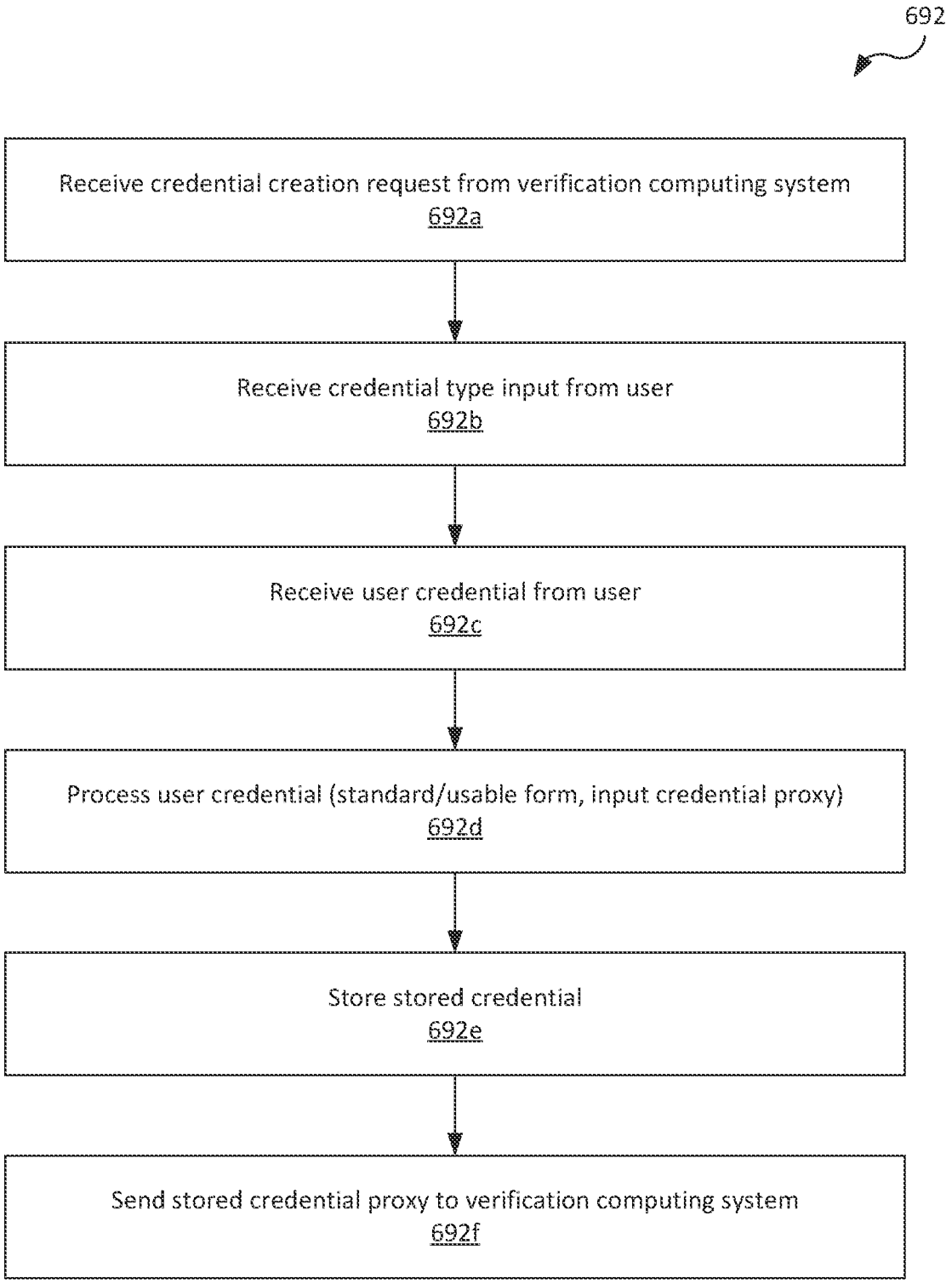
FIG. 6B is a flowchart of a method for creating user credentials with the user device.

Referring to FIGS. 6A-6B, the user device 180 is configured to initially receive and store user credentials and send the stored credential 181*a* to the verification computing system 140 during user authorization.

Referring to FIG. 6A, the user device 180 is a computing device associated with the user, such as a smartphone or other portable or stationary computing device. The user device 180 generally includes a controller 210, a communications interface 682, a user interface 684, and a credential input device 686 that may, in some circumstances, be provided by the user interface 684. The controller the controller 210 of the user device 180 is configured to execute instructions to provide the functionality described herein. The communications interface 682 is configured to be in communication with the verification computing system 140 and includes suitable hardware configured to communicate with the verification computing system 140 according to any suitable protocols and with any intervening devices (e.g., via a cellular radio to the network 102). The user interface 684 is configured to provide outputs to and receive inputs from the user, for example, including a touch screen display, physical buttons, and/or audio devices (e.g., microphones and/or speakers). The credential input device 686 is configured to receive the credential of the user 18 and includes suitable sensors and/or other hardware to collect credential data. The credential input device 686 may, for example, include those sensors and/or other hardware of the types described for the credential input device 564 of the local access control subsystem 160 (e.g., for facial recognition, fingerprint recognition, pass words or phrases, input code, and/or combined pass code or phrase and voice recognition). In some embodiments, the user interface 684 may function as the credential input device 686 (e.g., being configured as a touch sensitive display that displays a keypad).

Referring to FIG. 6B, the user device 180 performs one or more methods according to instructions stored therein (e.g., one or more applications or software stored thereby), which include a first method 692 for receiving, processing, and storing input credentials and a second method 694 for verifying the user 18 seeking access to one of the spaces 2.

The first method 692 generally includes a first block 692*a* at which a credential request is received, a second block 692*b* at which a credential type input is received, a third block 692*c* at which user credential is received, a fourth block 692*d* at which the user credential is processed, a fifth block 692*e* at which the user credential is stored, and a sixth block 692*f* at which the stored credential proxy is sent. If the local access control subsystem 160 is designated to be used in an offline or secondary mode of operation for verifying users, the sixth block 692*f* may also include sending the stored credential 181*a* to the verification computing system 140 for transfer to the local access control subsystem 160.

At the first block 692*a*, the user device 180 receives a request from the verification computing system 140 (e.g., with the communications interface 682 thereof), which may be referred to as the credential creation request 141*c*. If the user 18 of the user device 180 has not previously received access rights and/or the user device 180 has not previously installed the software application by which other blocks of this method 692 are implemented, the credential creation request 141*c* may be in the form of a standard message that most types of the user devices 180 (e.g., smartphones) are configured to receive, such as an SMS text message with a link to download or otherwise acquire the application by which the first block 692*a* and other blocks of this method 692 may be implemented. If the user 18 has previously received access rights and/or the user device 180 has previously installed the software application, the credential creation request 141*c* may result in a notification provided by the user device 180 according thereto for the user to create a new credential.

At the second block 692*b*, the user device 180 receives an input or selection of a credential type from the user 18 (e.g., with the user interface 684, such as a touch screen). For example, the user device 180, in response to the credential creation request 141*c*, may prompt the user 18 to select a type of user credential. More particularly, for a given access rights record 141*a*, the type of user credential input by the user to the user device 180 must be of the same type of user credentials receivable by the local access control subsystem 160 of that access rights record 141*a*.

For example, each of the local access control subsystem 160 and the user device 180 may both be configured to receive more than one of the same types of user credentials (e.g., more than one of facial recognition, speech recognition, voice recognition, and/or pin codes). In this case, the user device 180 may prompt the user 18 to select a preferred type of user credential or may default to a more secure type of user credential (e.g., facial recognition over pin codes). In the case of a default type of user credential or only one type of user credential being acceptable by both the user device 180 and the local access control subsystem 160, the user device 180 does not prompt the user to select a type of user credential.

Furthermore, for each new access rights record 141*a* for the user 18 that requires a type of user credential not previously created, the user device 180 prompts (e.g., in response to another credential creation request 141*c* from the verification computing system 140) the user 18 to select different type of user credential. For example, if the user 18 previously selected facial recognition, the user 18 may be prompted to select a speech credential or pin code.

At the third block 692*c*, the user device 180 receives the user credential with the credential input device 686 in a similar manner to that described for the credential input device 564 of the local access control subsystem 160. For example, the controller 210 operates the credential input device 686 (e.g., the various sensors thereof) to receive or otherwise collect credential information, such as facial data, speech data, voice data, and/or pin codes).

At the fourth block 692*d*, the user device 180 (e.g., the controller 210 or other processor thereof) processes the stored credential generally as described above for the processing of the user credentials with the local access control subsystem 160 (e.g., in the second block 572*b* of the method 572). The credential information received by the credential input device 686 is processed to represent the stored credential 181*a* in a standard or otherwise usable format. The stored credential proxy 181*b* is processed from the stored credential 181*a* according to the same algorithm according to which the input credential proxy 161*b* is generated from the input credential 161*a*. The stored credential 181*a* and the stored credential proxy 181*b* be processed further into a secure form (e.g., encrypted).

At the fifth block 692*e*, the user device 180 stores the user credential as processed by the user device 180 as the stored credential 181*a*, which may be in a secure or unsecure form (e.g., in the storage 214 of the controller 210 of the user device 180).

At the sixth block 692*f*, the user device 180 user device 180 (e.g., the communications interface 682 as operated by the controller 210) sends the stored credential proxy 181*b* to the verification computing system 140 to be stored thereby (as described above with respect to the fourth block 452*d* of the first method 452) in or for association with the access rights record 141*a* (e.g., in separate records that both include a user identifier).

Figure 6C:
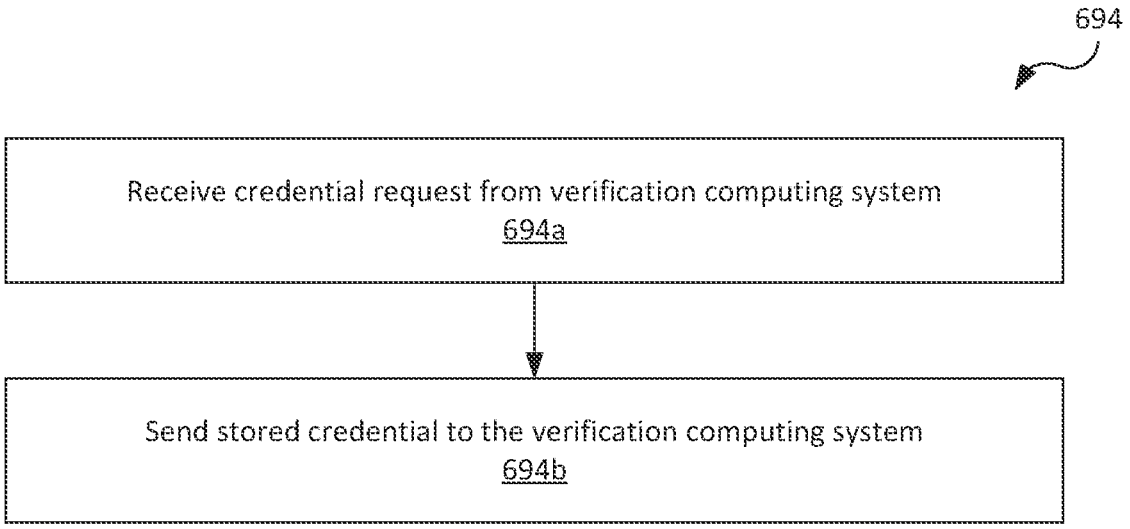
FIG. 6C is a flowchart of a method for sending user credentials for user verification with the user device.

Referring to FIG. 6C, when the user 18 seeks access to the space 2 with the local access control subsystem 160, the user device 180 performs the second method 694 to send the stored credential 181*a* to the verification computing system 140.

At the first block 694*a*, the user device receives credential sending requests 141*d* from the verification computing system 140 for the user device 180 to send the stored credential 181*a* to the verification computing system 140.

At the second block 694*b*, the user device 180 sends the stored credential 181*a*, which may be in the secure form, to the verification computing system 140 in response to the credential sending request 141*d*. As described previously, the verification computing system 140 then compares the stored credential 181*a* and the input credential 161 to authorize the user 18.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Further the methods described herein may be embodied in a computer-readable medium. The term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

As a person skilled in the art will readily appreciate, the above description is meant as an illustration of the principles of this invention. This description is not intended to limit the scope or application of this invention in that the invention is susceptible to modification, variation and change, without departing from spirit of this invention, as defined in the following claims.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. An access control system comprising:

a verification computing system including one or more computing devices that each includes a processor, a storage, a memory, and a communications interface, the verification computing system being in communication via the communications interface with local access control subsystems associated with spaces, one or more manager devices associated with managers, and one or more user devices associated with users;

wherein the verification computing system:

stores access rights information received from the one or more manager devices, the access rights information being for each of the users to access one or more of the spaces with the local access control subsystem associated therewith;

stores stored credential proxies received from the user devices in or for association with the access rights information, each stored credential proxy being irreversibly derived from a stored credential with an algorithm by the user device, and the stored credential including identifying information of the user received by the user device associated with the user;

receives, when a present user of one of the users seeks access to one of the spaces with the local access control subsystem therewith, from the local access control subsystem an input credential and an input credential proxy, the input credential including the identifying information of the present user received by the local access control subsystem, and the input credential proxy being irreversibly derived from the input credential with the algorithm by the local access control subsystem;

identifies the access rights information associated with the user by matching the input credential proxy with one of the stored credential proxies;

requests and receives a stored credential from the user device associated with the user, the stored credential having been stored by the user device associated with the present user; and compares the stored credential to the input credential to authorize the present user.

2. The access control system according to claim 1, wherein the verification computing system stores the access rights information in access rights records in one or more blockchains.

3. The access control system according to claim 2, wherein the verification computing system includes multiple computing devices that each form a node of a blockchain system that stores the one or more blockchains.

4. The access control system according to claim 3, wherein the access rights records for each of the users for one of the spaces includes identifying information of the user, the stored credential proxy of the user, identifying information of one or both of the space or the local access control subsystem associated with the space to which the user is being permitted access, and time information for when the user is permitted access to the space.

5. The access control system according to claim 1, wherein the access rights information is stored by the verification computing system in access rights records that each include space information that identifies one or both of the space or the local access control subsystem associated with the space to which the user is being permitted access, time information for when the user is permitted access to the space, and a user identifier that identifies the user being permitted access to the space; and wherein for each user, the user identifier is stored by the verification computing system in association with the stored credential proxies.

6. The access control system according to claim 1, wherein upon receiving new access rights information from the manager device for one of the users, the verification computing system sends a credential creation request to the user device associated with the one user to input a different type of user credential receivable by the local access control subsystem if the one user has not previously input a type of user credential receivable by the local access control subsystem associated with the new access rights information.

7. The access control system according to claim 1, wherein upon comparing the stored credential and the input credential, the verification computing system purges the stored credential and the input credential therefrom.

8. The access control system according to claim 1, wherein if the stored credential and the input credential are favorably compared, the verification computing system sends an authorization signal to the local access control subsystem indicating that the present user is authorized.

9. The access control system according to claim 8, further comprising the local access control subsystem, whereupon receiving the authorization signal from the verification computing system, the local access control subsystem permits the present user access the space associated therewith.

10. A method for providing access control comprising:

storing, with a computing system, access rights records for users for spaces that include user identifying information of the user, a stored credential proxy of the user, space identifying information of one or both of the space or a local access control subsystem associated with the space to which the user is being permitted access, and time information for when the user is permitted access to the space;

receiving, with the computing system, an input credential and an input credential proxy from a local access control subsystem;

identifying, with the computing system, one of the access rights records having one of the stored credential proxies that corresponds to the input credential proxy, space identifying information that corresponds to the local access control subsystem from which the input credential and the input credential proxy were received, and time information that corresponds to a current time;

requesting and receiving, with the computing system, a stored credential from a user device associated with the user identifying information of the one access rights record;

comparing, with the computing system, the stored credential with the input credential; and sending, with the computing system, an authorization signal to the local access control subsystem according to the comparing of the stored credential with the input credential;

wherein the stored credential proxies are irreversibly derived from the stored credential with an algorithm by user device associated with the users, and the stored credentials include identifying information of the users received by the user devices; and wherein the input credential includes identifying information of a present user received by the local access control subsystem, and the input credential proxy is irreversibly derived from the input credential with the algorithm by the local access control subsystem.

11. The method according to claim 10, wherein the computing system stores the access rights records in one or more blockchains.

12. The method according to claim 11, wherein the computing system includes multiple computing devices that each form a node of a blockchain system that stores the one or more blockchains.

13. The method according to claim 10, further comprising purging, with the computing system, the stored credential and the input credential after comparing the stored credential and the input credential.

14. The method according to claim 10, wherein the authorization signal indicates that the present user is authorized if the stored credential and the input credential are favorably compared.

15. The method according to claim 10, further comprising:

receiving, with the local access control subsystem, the input credential from the present user;

processing, with the local access control subsystem, the input credential to generate the input credential proxy with the algorithm;

sending, with the local access control subsystem, the input credential and the input credential proxy to the computing system;

receiving, with the local access control subsystem, the authorization signal from the computing system; and permitting or denying access, with the local access control subsystem, of the present user to the space according to the authorization signal.

16. A non-transitory computer-readable medium storing instructions that, when executed by one or more processors of a computing system, causes the computing system to perform operations including:

storing access rights records for users for spaces that include user identifying information of the user, a stored credential proxy of the user, space identifying information of one or both of the space or the local access control subsystem associated with the space to which the user is being permitted access, and time information for when the user is permitted access to the space;

receiving an input credential and an input credential proxy from a local access control subsystem;

identifying one of the access rights records having one of the stored credential proxies that corresponds to the input credential proxy, space identifying information that corresponds to the local access control subsystem from which the input credential and the input credential proxy were received, and time information that corresponds to a current time;

requesting and receiving a stored credential from a user device associated with the user identifying information of the one access rights record;

comparing the stored credential with the input credential; and sending an authorization signal to the local access control subsystem according to the comparing of the stored credential with the input credential;

wherein the stored credential proxies are irreversibly derived from the stored credential with an algorithm by user device associated with the users, and the stored credentials include identifying information of the users received by the user devices; and wherein the input credential includes identifying information of a present user received by the local access control subsystem, and the input credential proxy is irreversibly derived from the input credential with the algorithm by the local access control subsystem.

17. The non-transitory computer-readable medium according to claim 16, wherein the operations additionally include storing the access rights records in one or more blockchains.

18. The non-transitory computer-readable medium according to claim 17, wherein the operation of storing the access rights records in one or more blockchains is performed by more than one computing device of the computing system.

19. The non-transitory computer-readable medium according to claim 16, wherein the operations additionally include purging from the computing system the stored credential and the input credential after comparing the stored credential and the input credential.

20. The non-transitory computer-readable medium according to claim 16, wherein the authorization signal indicates that the present user is authorized if the stored credential and the input credential are favorably compared.

* * * * *